US012250991B2

(12) United States Patent
Wright et al.

(10) Patent No.: US 12,250,991 B2
(45) Date of Patent: Mar. 18, 2025

(54) SOLE STRUCTURES AND/OR ARTICLES OF FOOTWEAR HAVING EXPANDABLE LUGS FOR ENGAGING FOOTWEAR COMPONENTS TOGETHER

(71) Applicant: NIKE, Inc., Beaverton, OR (US)

(72) Inventors: Courtney M. Wright, Portland, OR (US); Laura C. Marshala, Portland, OR (US); Keith T. Kuntz, Portland, OR (US); Jessica Junkins, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/381,968

(22) Filed: Oct. 19, 2023

(65) Prior Publication Data

US 2024/0130474 A1 Apr. 25, 2024
US 2024/0225190 A9 Jul. 11, 2024

Related U.S. Application Data

(60) Provisional application No. 63/418,198, filed on Oct. 21, 2022.

(51) Int. Cl.
*A43B 13/36* (2006.01)

(52) U.S. Cl.
CPC ..... *A43B 13/36* (2013.01)

(58) Field of Classification Search
CPC ..... A43B 13/36; A43B 13/30; A43B 13/023; A43B 3/0047; A43B 3/244; A43C 15/16; A43C 15/161; A43C 15/02
See application file for complete search history.

(56) References Cited

U.S. PATENT DOCUMENTS 4,420,894 A * 12/1983 Glassman ..... A43B 13/36 36/12
4,999,931 A * 3/1991 Vermeulen ..... A43B 13/185 36/153
2005/0188562 A1* 9/2005 Clarke ..... A43B 3/244 36/3 R (Continued)

OTHER PUBLICATIONS

Dec. 19, 2023 (WO) International Search Report and Written Opinion—App PCT/US2023/077400, 11 pages.

*Primary Examiner* — Jillian K Pierorazio
(74) *Attorney, Agent, or Firm* — Banner & Witcoff, Ltd.

(57) ABSTRACT

Articles of footwear include one or more expandable lugs (e.g., inflatable lugs) to hold at least some footwear component parts together. The expandable lug(s) may be included as part of an impact force-attenuating component (e.g., a fluid-filled bladder) for the article of footwear. The expandable lug(s) extend into receptacle(s) provided in a foot support component in an unexpanded (e.g., deflated or low-pressure) condition. Once within the receptacle(s), the expandable lug(s) are changed to an expanded (e.g., inflated or high-pressure) condition. The expanded lug(s) engage bearing surfaces provided inside the receptacle(s) to prevent the lugs from pulling out of the receptacles. The use of such expandable lugs for securing footwear component parts together may enable easy assembly of footwear components without use of adhesives and/or separate hardware components, which can enhance the recyclability, sustainability, and environmental friendliness of articles of footwear and their production methods.

20 Claims, 14 Drawing Sheets

(56) References Cited

U.S. PATENT DOCUMENTS

| | | | | |
|---|---|---|---|---|
| 2005/0268491 | A1* | 12/2005 | McDonald | A43B 9/00 36/28 |
| 2008/0168681 | A1* | 7/2008 | Andersen | A43B 13/12 36/15 |
| 2018/0338575 | A1* | 11/2018 | Elder | A43B 13/145 |
| 2020/0359743 | A1* | 11/2020 | Bentvelzen | G06Q 50/04 |
| 2022/0132987 | A1* | 5/2022 | Case | B32B 1/00 36/29 |
| 2022/0346497 | A1* | 11/2022 | Case | B32B 7/05 |

* cited by examiner

SOLE STRUCTURES AND/OR ARTICLES OF FOOTWEAR HAVING EXPANDABLE LUGS FOR ENGAGING FOOTWEAR COMPONENTS TOGETHER

CROSS-REFERENCE TO RELATED APPLICATION

The present application claims priority to and the benefit of U.S. Provisional Patent Application No. 63/418,198 filed Oct. 21, 2022, which is incorporated by reference herein in its entirety.

FIELD OF THE INVENTION

Aspects of the present technology relate to sole structures and/or articles of footwear that include one or more expandable lugs (e.g., inflatable lugs) to hold at least some footwear component parts together. Additional aspects of the present technology relate to methods of assembling sole structures and/or articles of footwear using expandable lugs to hold at least some of the footwear component parts together. Still additional aspects of the present technology relate to methods of disassembling sole structures and/or articles of footwear that include expandable lugs holding at least some of the footwear component parts together.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

SUMMARY

As noted above, aspects of the present technology relate to sole structures and/or articles of footwear that include one or more expandable lugs (e.g., inflatable lugs) to hold at least some footwear component parts together. The expandable lug(s) may be included as part of an impact force-attenuating component (e.g., a fluid-filled bladder) that may form at least a portion of a midsole component and/or sole structure for the article of footwear. Additional aspects of the present technology relate to methods of assembling sole structures and/or articles of footwear using one or more expandable lugs to hold at least some of the footwear component parts together. Still additional aspects of the present technology relate to methods of disassembling sole structures and/or articles of footwear that include one or more expandable lugs to hold at least some of the footwear component parts together. The use of such expandable lugs for securing footwear component parts together may enable easy assembly of footwear components without use of adhesives and/or separate hardware components, which can enhance the recyclability, sustainability, and environmental friendliness of sole structures, articles of footwear, their use, and their production methods.

BRIEF DESCRIPTION OF THE DRAWINGS

The following Detailed Description will be better understood when considered in conjunction with the accompanying drawings in which like reference numerals refer to the same or similar elements in all of the various views in which that reference number appears.

DETAILED DESCRIPTION

Figure 2:
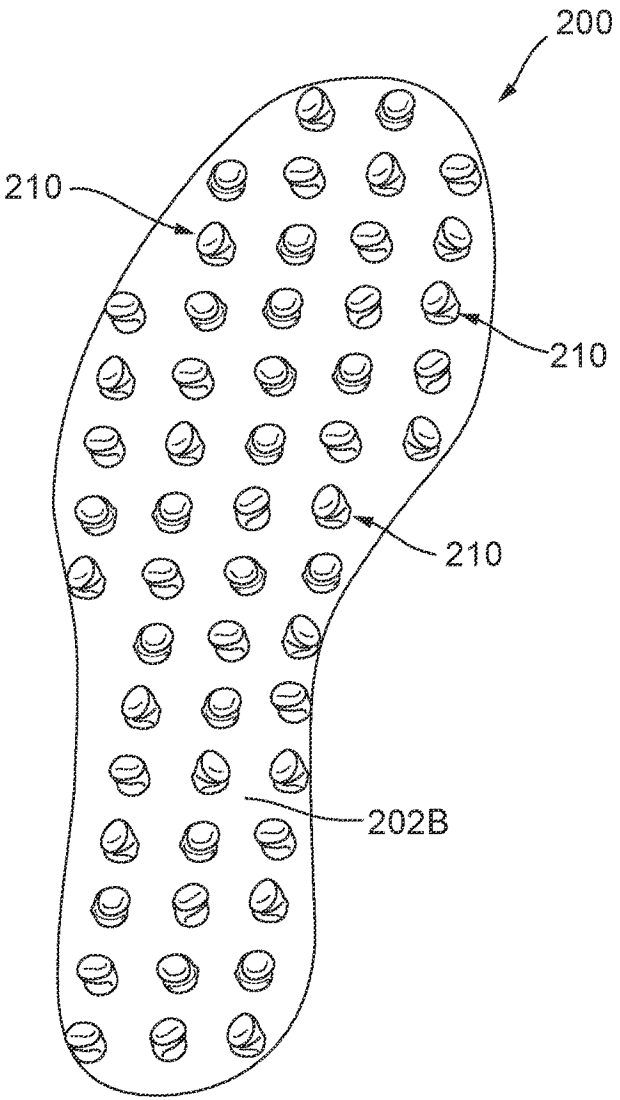
FIG. 2 illustrates an example impact force-attenuating component (e.g., an inflatable bladder) in accordance with some aspects of this technology.

In the following description of various examples of footwear structures and component parts according to the present technology, reference is made to the accompanying drawings, which form a part hereof, and in which are shown by way of illustration various example structures, methods, and environments in which aspects of this technology may be practiced. It is to be understood that other structures, methods, and environments may be utilized and that structural and functional modifications may be made to the specifically described structures, functions, and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, etc.), and the like.

This application and/or claims use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "third" in the specification may correspond to any numerical adjective used for that component or feature in the claims).

Various structures and parameters of articles of footwear and components thereof are described based on a "longitudinal length" parameter L. See FIG. 16. The longitudinal length L can be found with the article of footwear and/or sole structure oriented on a horizontal support surface on its ground-facing surface in an unloaded condition (e.g., with no weight applied to it other than weight of other components of the article of footwear and/or sole structure). Once so oriented, parallel vertical planes VP that are perpendicular to the horizontal support surface (into and out of the page of FIG. 16) are oriented to contact the rearmost heel (RH) location(s) and forwardmost toe (FT) location(s) of the article of footwear and/or sole structure. The parallel vertical planes VP should be oriented facing one another, and as far away from one another as possible while still in contact with the rearmost heel RH and forwardmost toe FT locations. The direct distance between these vertical planes VPs corresponds to the length (e.g., a longitudinal length) L of the article of footwear and/or sole structure. The locations of some footwear components may be described in this specification based on their respective locations along the longitudinal length L as measured forward from the rear heel vertical plane VP. Thus, the rearmost heel location(s) is (are) located at position 0L and the forwardmost toe location(s) is (are) located at position 1L along the longitudinal length L. Intermediate locations along the longitudinal length L are referred to by fractional locations (e.g., 0.33L or 0.66L) along the longitudinal length L measured forward from the rear heel vertical plane VP. The term "parallel planes" as used herein are planes oriented parallel to the vertical planes VP. These parallel planes may intersect the longitudinal length or longitudinal direction somewhere between P=0L and P=1.0L.

Figure 16:
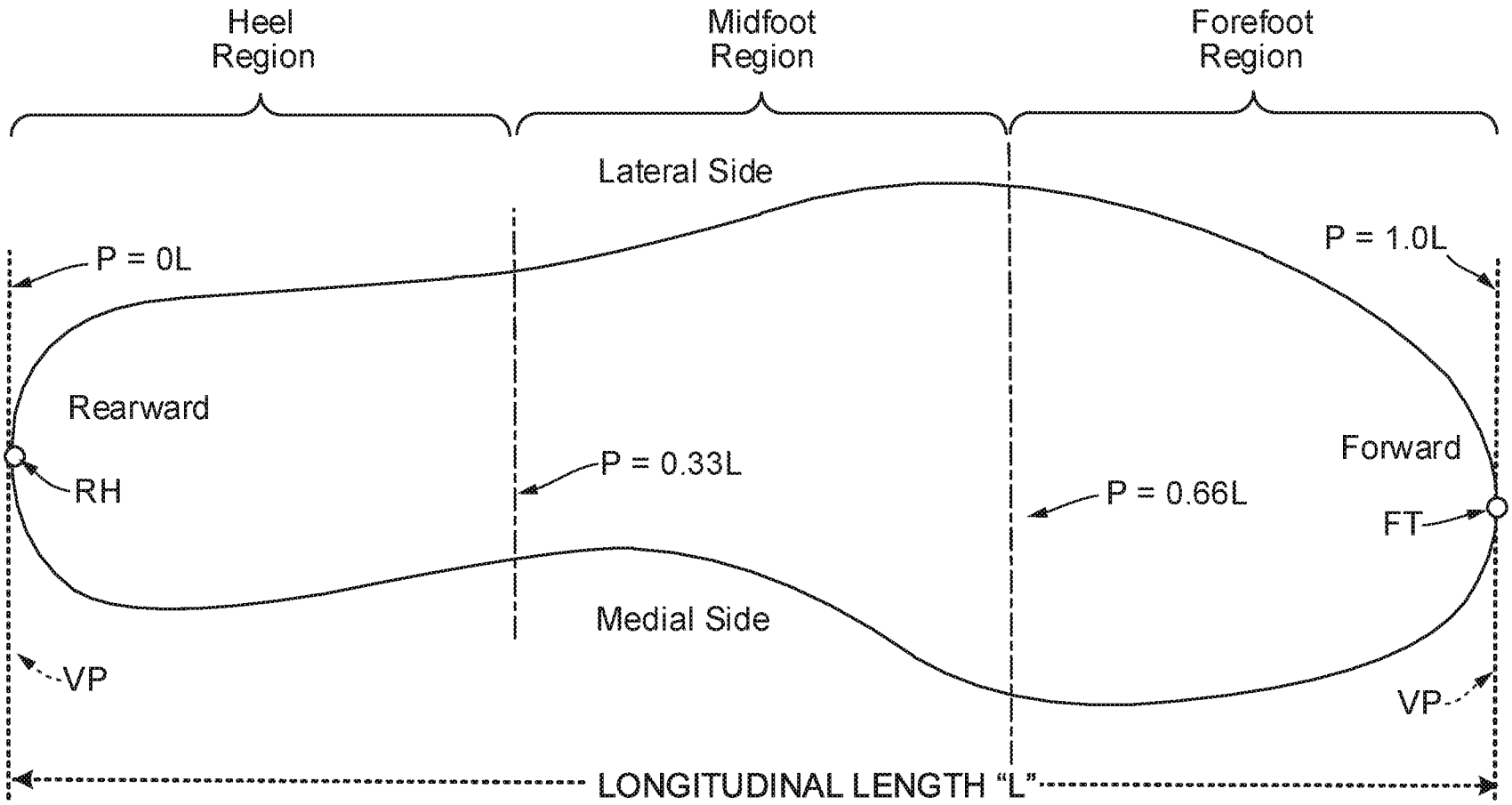
FIG. 16 shows a generic footwear component (e.g., a bottom view of a sole structure) used to illustrate various terms and definitions used in this specification.

The term "rearward" as used herein means at or toward the heel region of the article of footwear (or component thereof), and the term "forward" as used herein means at or toward a forefoot or forward toe region of the article of footwear (or component thereof). See FIG. 16. As also shown in FIG. 16, the terms "heel," "heel area," or "heel region" as used herein generally refer to a region bounded by parallel planes at 0L and 0.33L. The terms "midfoot," "midfoot area," or "midfoot region" as used herein generally refer to a region bounded by parallel planes at 0.33L and 0.66L. The terms "forefoot," "forefoot area," or "forefoot region" as used herein generally refer to a region bounded by parallel planes at 0.66L and 1.0L. Also, the term "lateral" means the "little toe" side of an article of footwear or component thereof (e.g., an upper, a sole structure, etc.), and the term "medial" means the "big toe" side of an article of footwear or component thereof (e.g., an upper, a sole structure, etc.). The directional terms "upper," lower," "top," and/or "bottom" and the like, as used herein, unless otherwise noted or clear from the context, refer to a direction or position with the article of footwear and/or other component oriented with its ground-facing surface supported on or facing a horizontal contact surface (e.g., level ground). The term "upper" also is used herein as a noun to refer to a footwear component structure (as conventionally used in the footwear art).

The term "providing" as used herein in the context of method steps, such as "providing an upper component," "providing a foot support component," "providing an inflatable bladder," and/or "providing an impact force-attenuating component," means any manner of making the identified component available for use in further method steps. Thus, the term "providing" in this context includes, but is not limited to: manufacturing the noted component, assembling the noted component, purchasing the noted component, obtaining the noted component from a third-party supplier or other source, retrieving the noted component from storage or inventory, reclaiming the noted component from a previously formed product, etc.

I. GENERAL DESCRIPTION OF ASPECTS OF THIS TECHNOLOGY

Sole structures and/or articles of footwear in accordance with some aspects of this technology include removable (and potentially interchangeable) components (e.g., foot support components that are removably engaged with impact force-attenuating components and/or sole components that are removably engaged with footwear upper components). In at least some aspects of this technology, the footwear component parts may be assembled in an adhesive-free manner. One or more of the footwear components (e.g., one or more of an upper component, an impact force-attenuating component, a foot support component, etc.) may be formed from a single material, may be formed as a unitary, one-piece construction, may be formed from recycled materials, and/or may themselves be recyclable.

Some aspects of this technology relate to articles of footwear that include: (a) an upper component having a first through hole opening (e.g., in a bottom surface thereof, in a strobel component, etc.); (b) a foot support component (e.g., a midsole component, an outsole component, etc.) having a first surface, wherein the foot support component is shaped to form a first receptacle having a first interior chamber, and wherein a first opening defined at the first surface provides access to the first interior chamber; and (c) an impact force-attenuating component (e.g., an inflatable bladder) including: (i) a foot support surface for supporting at least a portion of a plantar surface of a wearer's foot (e.g., a top surface or sheet of a fluid-filled bladder), (ii) a base surface opposite the foot support surface (e.g., a bottom surface or sheet of a fluid-filled bladder), and (iii) a first expandable lug (e.g., an inflatable lug) extending from the base surface, wherein a sealed fluid chamber is defined at least within the first expandable lug. The first expandable lug may extend through the first through hole opening and into the first receptacle. When the sealed fluid chamber is filled with a fluid (e.g., inflated with a gas), the first expandable lug has a size and/or shape and/or rigidity that inhibits the first expandable lug from pulling out of the first interior chamber through the first opening. The interior surface of the first interior chamber may provide an "undercut" or "bearing surface" that engages the exterior surface of the first expandable lug to prevent the first expandable lug from pulling out of the first interior chamber or first receptacle through the first opening. In at least some examples, articles of footwear may include: (i) uppers with plural through hole openings, (ii) foot support components with plural receptacles and/or plural openings providing access the receptacle(s); and/or (iii) impact force-attenuating components having plural expandable lugs (e.g., inflatable lugs). Sole structures in accordance with at least some examples of this technology may include the foot support components and impact force-attenuating components as described above without the upper component.

Additional aspects of this technology relate to methods of assembling articles of footwear that include: (a) providing an upper component having a first through hole opening (e.g., in a bottom surface thereof, in a strobel component, etc.); (b) providing a foot support component (e.g., a midsole component, an outsole component, etc.) having a first surface, wherein the foot support component is shaped to form a first receptacle having a first interior chamber, and wherein a first opening defined at the first surface provides access to the first interior chamber; and (c) providing an impact force-attenuating component (e.g., an inflatable bladder, etc.) having: (i) a foot support surface (e.g., a top surface or sheet of a fluid-filled bladder) for supporting at least a portion of a plantar surface of a wearer's foot, (ii) a base surface (e.g., a bottom surface or sheet of a fluid-filled bladder) opposite the foot support surface, and (iii) a first expandable lug (e.g., an inflatable lug) extending from the base surface, wherein a first fluid chamber is defined at least within the first expandable lug; (d) with the first fluid chamber in a contracted condition (e.g., a deflated condition, a low-pressure condition, etc.), positioning the base surface of the impact force-attenuating component with respect to the upper component such that the first expandable lug extends through the first through hole opening and into the first receptacle; and (e) with the first expandable lug extending into the first receptacle, introducing fluid (e.g., a gas, a liquid, etc.) into the first fluid chamber to change the first fluid chamber from the contracted condition to an expanded condition (e.g., an inflated condition, a high-pressure condition, etc.) during which a size and/or shape and/or rigidity of the first expandable lug changes such that the first expandable lug is inhibited from pulling out of the first interior chamber through the first opening. Assembly methods in accordance with at least some examples of this technology may be used for assembling articles of footwear having: (i) uppers with plural through hole openings, (ii) foot support components with plural receptacles and/or plural openings providing access the receptacle(s); and/or (iii) impact force-attenuating components having plural expandable lugs (e.g., inflatable lugs). Some methods of assembling sole structures and/or articles of footwear in accordance with at least some examples of this technology may include engaging the foot support components with the impact force-attenuating components as described above without including the upper component in the assembly method (e.g., the upper component may be incorporated into the assembly process in another manner and/or in other steps).

Still additional aspects of this technology relate to methods of disassembling sole structures and/or articles of footwear that include: (a) releasing fluid from at least a first expandable lug (e.g., an inflatable lug) of an impact force-attenuating component (e.g., an inflatable bladder), wherein the first expandable lug includes: (i) a base portion that extends to a first receptacle formed in a foot support component (e.g., a midsole component, an outsole component, etc.) and (ii) an expandable securing portion that, when filled with a fluid (e.g., a gas), has a size and/or shape and/or rigidity that inhibits the first expandable lug from pulling out of the first receptacle; and (b) after releasing sufficient fluid, removing the expandable securing portion of the first expandable lug from the first receptacle. The step of releasing the fluid may include puncturing a sealed fluid-filled bladder, opening a valve of the fluid-filled bladder, removing a cap from a port of the fluid-filled bladder, etc. Disassembly methods in accordance with at least some examples of this technology may be used for disassembling sole structures and/or articles of footwear having two or more of: (i) uppers with plural through hole openings, (ii) foot support components with plural receptacles and/or plural openings providing access the receptacle(s); and/or (iii) impact force-attenuating components having plural expandable lugs (e.g., inflatable lugs). Also, such disassembly methods may be used with sole structures and/or articles of footwear of the types described above and/or sole structures and/or articles of footwear made by the assembly methods described above.

Any one or more of the examples and aspects of this technology described above further may include any one or more of the following properties: (a) the sole structures and/or article of footwear may be assembled in an adhesive-free manner; (b) some or all of the component parts of the sole structures and/or article of footwear (e.g., at least the upper component, the foot support component, and/or the impact force-attenuating component (e.g., the inflatable bladder)) may be formed from a single material and/or as a unitary, one-piece construction; (c) some or all of the component parts of the sole structures and/or article of footwear (e.g., at least the upper component, the foot support component, and/or the impact force-attenuating component (e.g., the inflatable bladder)) may be releasably engaged together; and/or (d) some or all of the component parts of the sole structures and/or article of footwear (e.g., at least the upper component, the foot support component, and/or the impact force-attenuating component (e.g., the inflatable bladder)) may be recyclable and/or may be made from a recycled material.

Given the general description of features, examples, aspects, structures, processes, and arrangements according to certain aspects and examples of this technology provided above, a more detailed description of specific example sole structures, articles of footwear, and/or methods in accordance with this technology follows.

II. DETAILED DESCRIPTION OF EXAMPLE SOLE STRUCTURES, ARTICLES OF FOOTWEAR, AND COMPONENTS/FEATURES THEREOF ACCORDING TO ASPECTS OF THIS TECHNOLOGY

Referring to the figures and following discussion, examples of footwear components, sole structures, and articles of footwear in accordance with aspects of this technology are described. FIGS. 1-4 illustrate component parts of example articles of footwear in accordance with aspects of this technology and FIGS. 5A-5E more fully illustrate the assembly and various properties of such example articles of footwear and component parts.

Figure 1:
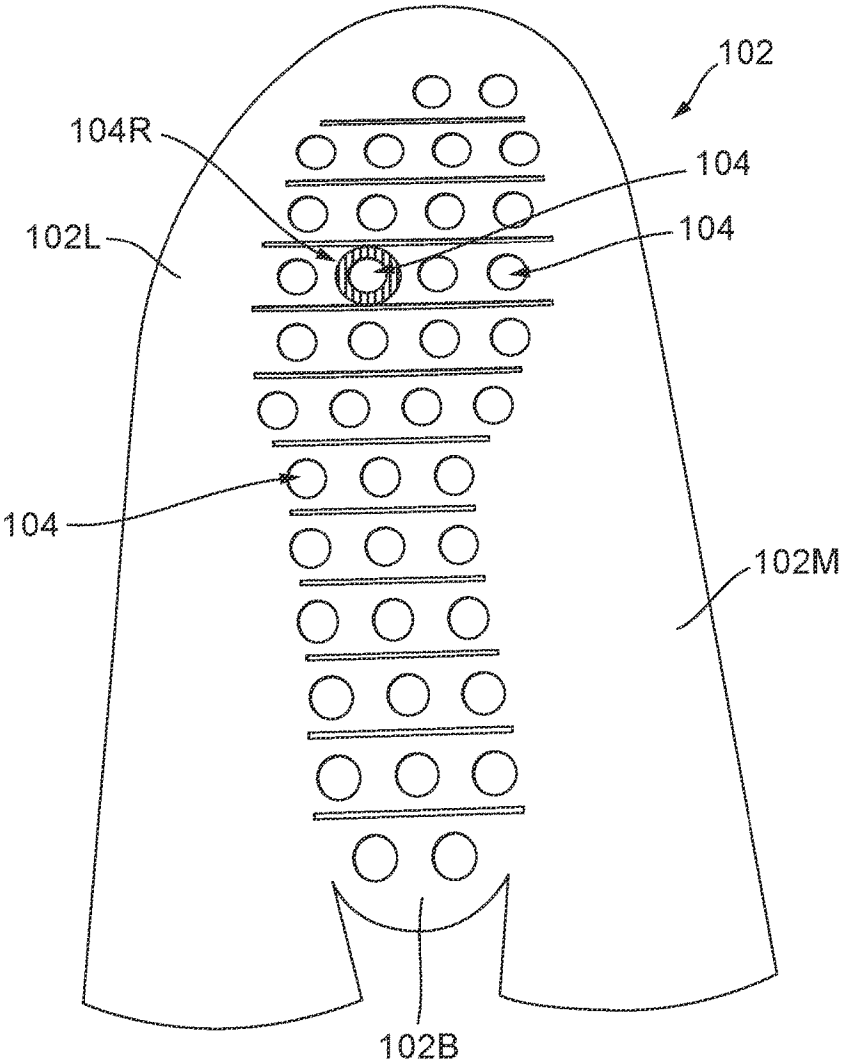
FIG. 1 illustrates an example upper component in accordance with some aspects of this technology.

FIG. 1 illustrates a bottom view of an example upper component 102 (formed as a flat upper blank in this illustrated example) for articles of footwear in accordance with some examples of this technology. The upper component 102 of this illustrated example is a single component part that includes a lateral side portion 102L, a medial side portion 102M, and a bottom panel 102B extending between and connecting the lateral side portion 102L and the medial side portion 102M. The bottom panel 102B of this example upper component 102 includes a plurality of through hole openings 104 extending completely through this upper component 102. While other arrangements are possible, the plurality of through hole openings 104 in this example are arranged in a plurality of rows extending in a medial side-to-lateral side direction of the upper component 102 (and of an article of footwear in which the upper component 102 is included). The through hole openings 104 also may be arranged in a plurality of columns extending in an anterior-to-posterior direction of the upper component 102 (and of an article of footwear in which the upper component 102 is included). Any desired number and/or arrangement of through hole openings 104 may be provided in examples of this technology.

The upper component 102 may be formed from any desired material and/or in any desired constructions, including materials and/or constructions conventionally known and used in the footwear arts. More specific examples include textile materials, fabric materials, plastic materials, knit components, woven components, molded components, etc. Further, upper component 102, e.g., as illustrated in FIG. 1, may form the complete upper for an article of footwear. Alternatively, in some examples, upper component 102, e.g., as shown in FIG. 1, may form one component of a multi-component footwear upper. Still additionally or alternatively, component 102 itself may be made as a single component part (e.g., a single continuous fabric or polymer component) or it may constitute multiple parts that are engaged together (e.g., by sewn seams, by mechanical fasteners, by adhesives, etc.). In some examples of this technology, the bottom panel 102B including one or more through hole openings 104 may form a strobel element for an article of footwear (which, optionally, may be stitched to one or more other components forming the lateral side portion 102L, the medial side portion 102M, and/or other components of an overall footwear upper). In some examples, the area around one or more of the through hole openings 104 may be reinforced, e.g., to inhibit stretch, deformation, and/or tearing of the upper component 102 at the opening(s) 104. As an example, FIG. 1 shows a reinforcing ring 104R, e.g., made of thicker fabric, heavier fabric, or plastic material (akin to a washer structure), around one through hole opening 104.

FIG. 2 illustrates an example impact force-attenuating component 200 (e.g., an inflatable bladder 200) that may be used in sole structures and/or articles of footwear in accordance with some examples of this technology. FIG. 2 provides a bottom view of the impact force-attenuating component 200, illustrating a base surface 202B for a portion of the impact force-attenuating component 200. One or more expandable lugs 210 (e.g., inflatable lugs 210) extend away from (e.g., downward from) the base surface 202B. The base surface 202B shown in FIG. 2 is located opposite a foot support surface 202A of the impact force-attenuating component 200 that is not seen in FIG. 2 (but foot support surface 202A is shown in other figures, such as FIGS. 5B-5C). Any desired number and/or arrangement of expandable lugs 210 may be provided in examples of this technology (e.g., matching the number and arrangement of the through hole openings 104 in an upper component 102 to which the impact force-attenuating component 200 is to be engaged).

Figure 3A:
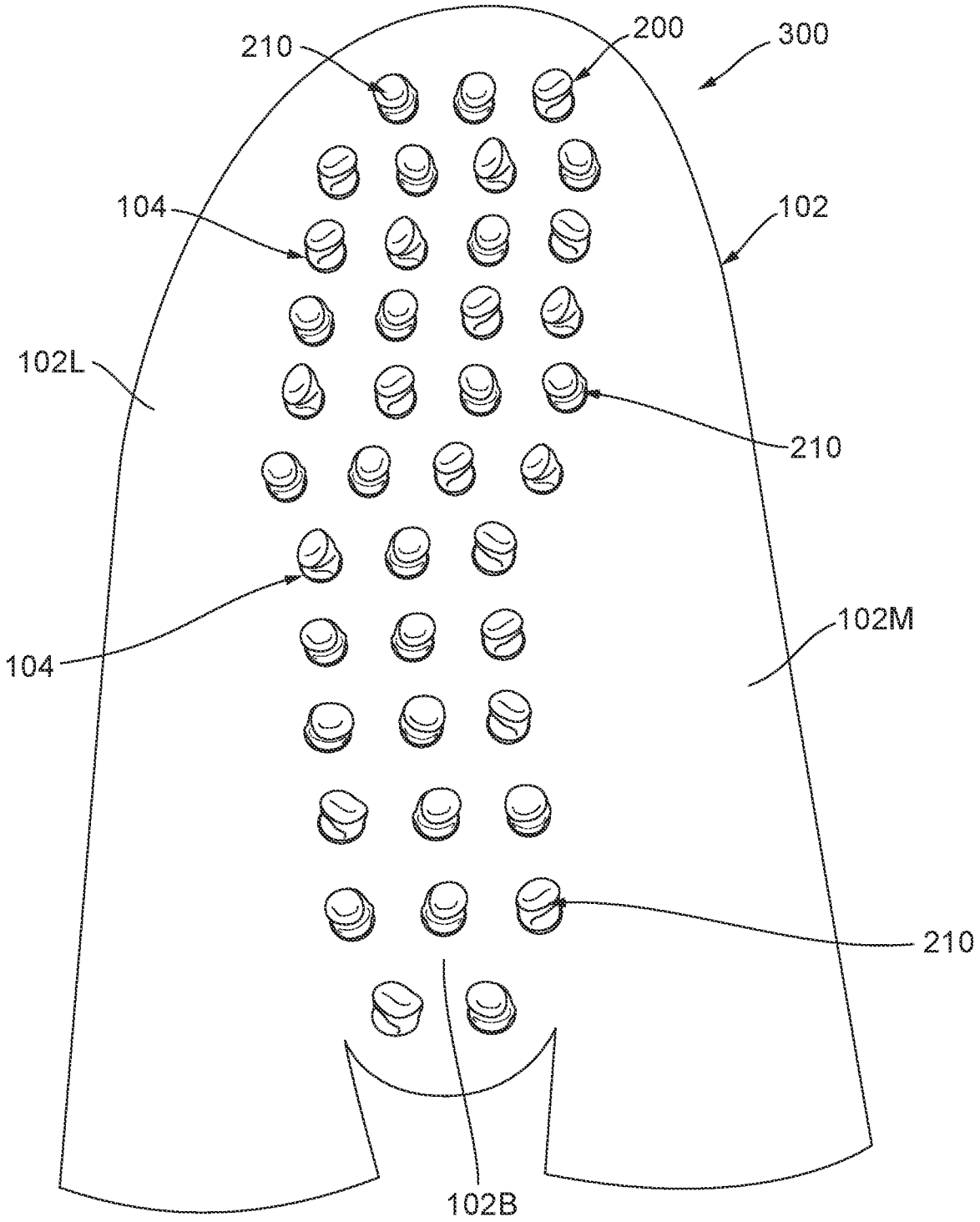
FIGS. 3A and 3B illustrate example features of engaging an upper component and an impact force-attenuating component in accordance with some aspects of this technology.
Figure 3B:
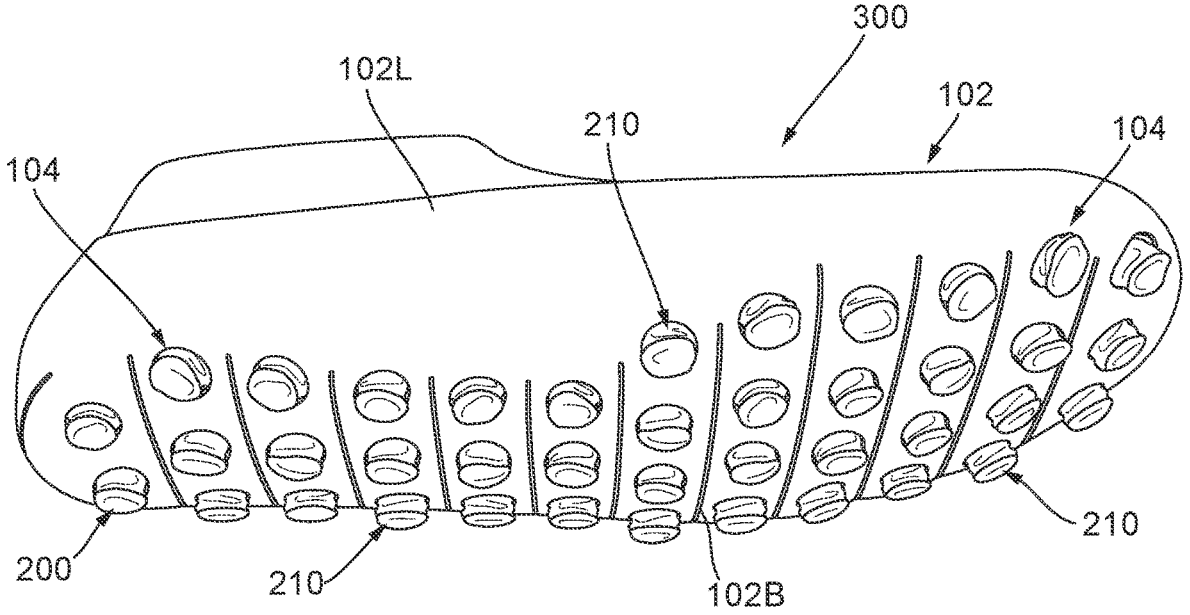

While the expandable lug 210 pattern shown in FIG. 2 does not match the exact through hole opening 104 pattern shown in FIG. 1, an impact force-attenuating component 200 (e.g., an inflatable bladder 200) could be produced in which the locations and pattern of expandable lugs 210 extending from the base surface 202B match the through hole opening 104 patterns shown in FIG. 1. For example, FIGS. 3A and 3B show a bottom view and a bottom, lateral perspective view, respectively, of an example upper component 102 in which expandable lugs 210 of an impact force-attenuating component 200 (e.g., an inflatable bladder 200) are arranged to match up with and extend through the through hole openings 104 in the bottom panel 102B of the upper component 102. In the arrangement shown in FIGS. 3A and 3B, the base surface 202B of the impact force-attenuating component 200 lies inside and is covered by the upper component 102, optionally in direct contact with the upward-facing surface (102BT, see FIGS. 5A and 5B) of the bottom panel 102B of the upper component 102. The combined upper component 102 and impact force-attenuating component 200 are referred to herein as footwear precursor component 300.

In this specification, the same reference number may be used when referring to a specific footwear component by its generic terminology and its more specific embodiment. For example, reference number "200" is used herein to refer both to a generic "impact force-attenuating component" and the more specific inflatable or fluid-filled "bladder." Similarly: (i) reference number "202A" is used herein to refer both to the more generic "foot support surface" of an impact force-attenuating component and a "first sheet" of the more specific inflatable bladder; (ii) reference number "202B" is used herein to refer both to the more generic "base surface" of an impact force-attenuating component and a "second sheet" of the more specific inflatable bladder; and (iii) reference number "210" is used herein to refer both to the more generic "expandable lug" of an impact force-attenuating component and an "inflatable lug" of the more specific inflatable bladder. When formed as an inflatable bladder 200, the bladder 200 may be formed from a thermoplastic polyurethane material (e.g., with a sealed, inflatable chamber defined between two "sheets" or portions of thermoplastic polyurethane material), including thermoplastic polyurethane materials ("TPU") as are conventionally known and used in the footwear and/or inflatable bladder arts. The thickness of the TPU material(s) may be selected and/or controlled (e.g., in the region of the expandable lug(s) 210) to provide a desired level of expandability to the lug(s) 210, to provide a desired level of flexibility to the lug(s) (e.g., in an uninflated or low-pressure condition), and/or to provide a desired level of rigidity to the lug(s) 210 and/or the bladder 200 (e.g., in an inflated or high-pressure condition).

Figure 4:
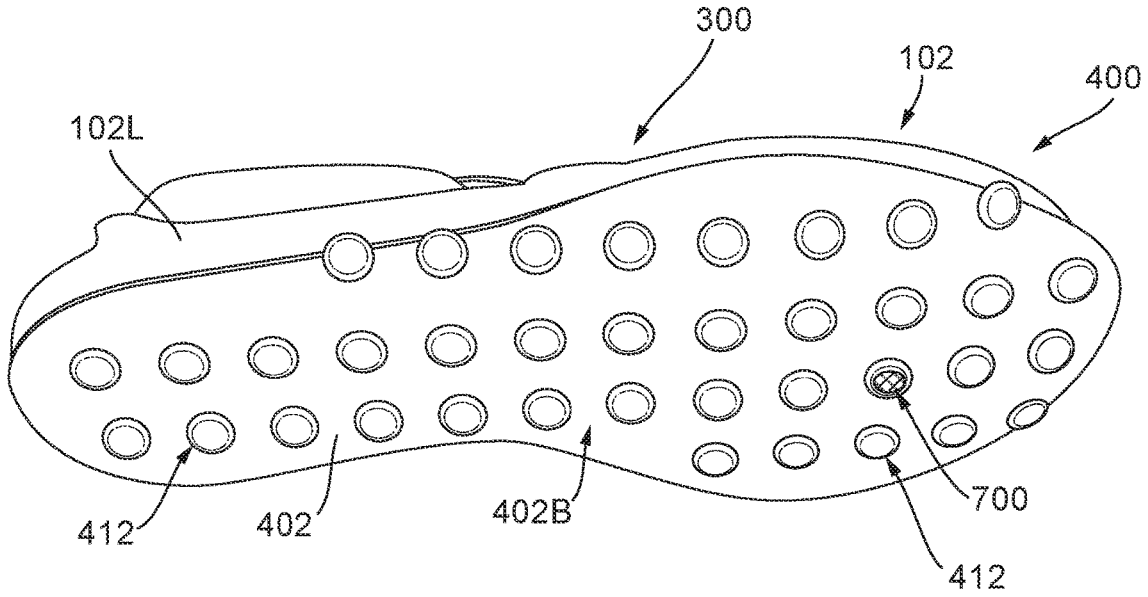
FIG. 4 illustrate an assembled article of footwear in accordance with some aspects of this technology.

FIG. 4 provides a bottom view of an overall article of footwear 400 in which the footwear precursor component 300 of FIGS. 3A and 3B is combined with a foot support component 402. The foot support component 402 may comprise or may function as a midsole component (e.g., an impact force-attenuating component, such as a polymeric foam material), an outsole component (e.g., a ground-engaging component, such as a rubber or thermoplastic material), or both. As will be explained in more detail in conjunction with FIGS. 5A-5E and 9, the foot support component 402 includes one or more receptacles 410 (see FIGS. 5A-5E) that correspond to the location(s) of the expandable lug(s) 210 and the through hole openings 104. In this manner (and as will be described in more detail below), expansion of the expandable lug(s) 210 within the receptacle(s) 410 may be used to secure the impact force-attenuating component 200 (and optionally the upper component 102) with the foot support component 402. As further shown in FIG. 5A, the expandable lugs 210 may include: (i) a base portion 220B, e.g., that extends through the through hole opening 104 of the upper component 102 (when present) and the opening 414 for a respective receptacle 410 in a foot support component 402 and (ii) an expandable securing portion 220E (e.g., an inflatable bulb) that extends from the base portion 220B and is received in the respective receptacle 410. In some examples, the expandable lugs 210 may have the appearance of a balloon-like structure extending from the base surface 202B of the impact force-attenuating component 200 (e.g., extending from the bottom sheet 202B of an inflatable bladder 200), with the base portion 220B forming the air inlet stem of the balloon-like structure and the expandable securing portion 220E forming the main body of the balloon-like structure. In the example of FIG. 4, ground-engaging lugs 412 provide the outer surface of the structure in which a corresponding receptacle 410 is defined. In the arrangement shown in FIG. 4, the bottom surface 102BB of the upper component 102 at least partially lies inside and is covered by the foot support component 402. In some examples, the bottom surface 102BB may lie in direct contact with the first surface 402T (e.g., the upward-facing surface) of the foot support component 402. See FIG. 5A.

The foot support component 402 may be formed in any desired manner. More specific examples include: injection molding or other molding techniques; 3D printing techniques; etc. Also, the foot support component 402 may be made of any desired materials, including materials conventionally known and used in the footwear arts, such as thermoplastic polymers, thermosetting polymers, rubber materials, etc. The foot support component 402 may function, at least in part, as a midsole component and/or an outsole component for the sole structures and/or articles of footwear in which it is incorporated.

Figure 5A:
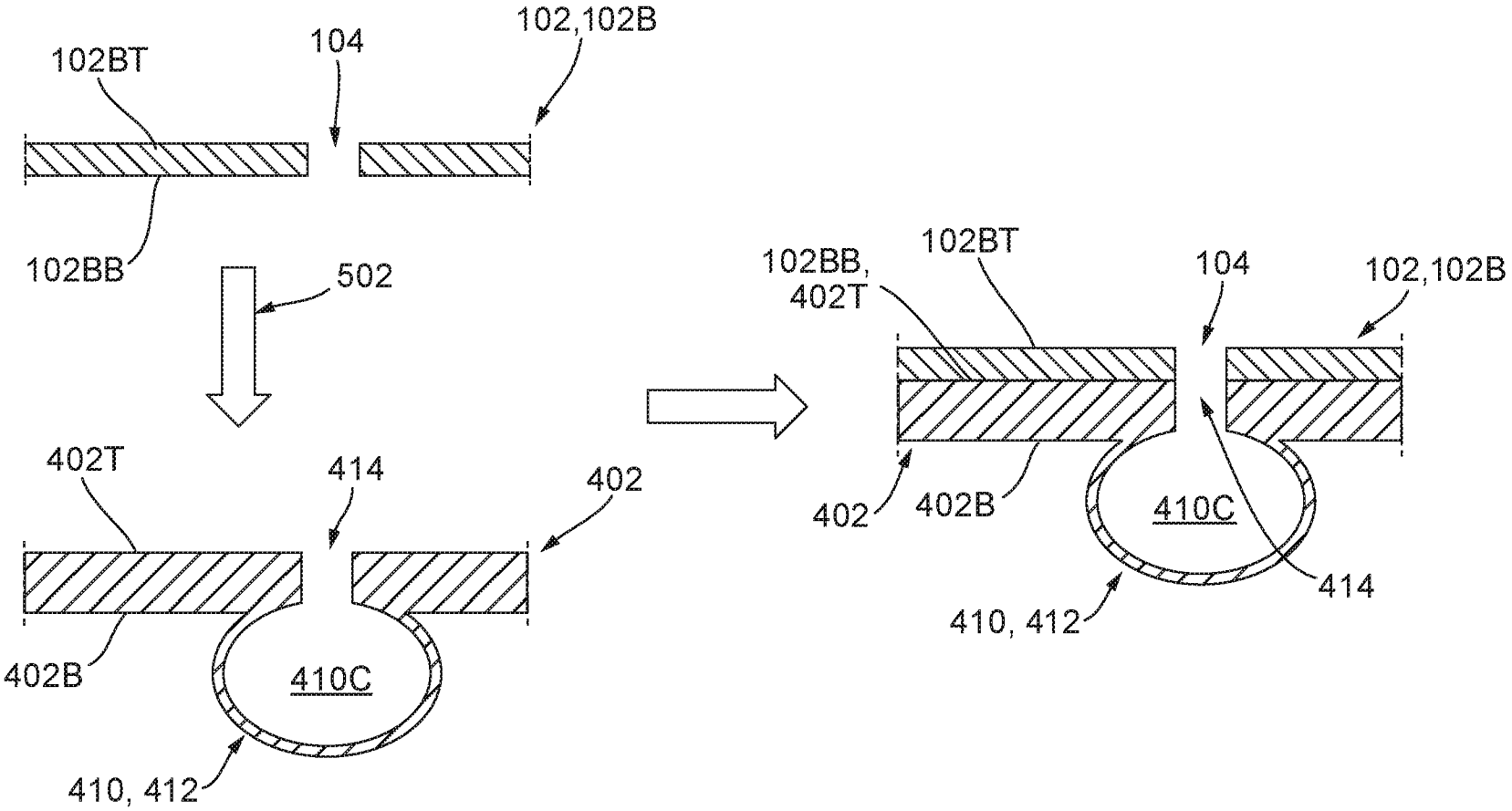
FIGS. 5A-5E illustrate various example steps of assembling and features of articles of footwear and components thereof in accordance with some aspects of this technology.

Assembly of example sole structures and/or articles of footwear 400 and various features of these components according to some examples of this technology will be described in more detail in conjunction with FIGS. 5A-5E. FIG. 5A illustrates one example step in an assembly process in which: (a) an upper component 102 is provided having at least a first through hole opening 104 (and optionally multiple openings 104, e.g., as shown in FIG. 1) and (b) a foot support component 402 is provided. The upper component 102 may comprise a fabric element (or other suitable footwear upper material) having a bottom panel 102B with a top surface 102BT and a bottom surface 102BB. The bottom panel 102B may comprise a footwear strobel element closing off a bottom of the overall footwear upper. The through hole opening(s) 104 extend completely through the upper component 102 bottom panel 102B from the top surface 102BT to the bottom surface 102BB.

The foot support component 402 of this example includes a first surface 402T (e.g., a top surface) and a second surface 402B (e.g., a bottom surface) opposite the first surface 402T. As shown in FIG. 5A, the foot support component 402 is shaped to form a first receptacle 410 (and optionally a plurality of receptacles 410). Each of the receptacle(s) 410 may provide or define an interior chamber 410C. An access opening 414 defined at the first surface 402T provides access to the interior chamber 410C of a respective receptacle 410.

The assembly step shown by arrow 502 in FIG. 5A includes positioning the bottom surface 102BB of the upper component 102 with respect to the first surface 402T of the foot support component 402 (e.g., in direct contact) such that the first through hole opening 104 of the upper component 102 and the first access opening 414 to the first receptacle 410 at least partially align (e.g., overlap in an axial direction of the openings 104, 414). When a plurality of through hole openings 104 and a corresponding plurality of access openings 414 and/or receptacles 410 are provided in a footwear structure, the step of FIG. 5A may include positioning the upper component 102 with respect to the foot support component 402 such that the through hole openings 104 of the upper component 102 at least partially align with the corresponding access openings 414 of the foot support component 402. No adhesive is provided between the bottom surface 102BB of the upper component 102 and the first surface 402T of the foot support component 402 in at least some examples of this assembly process.

Figure 5B:
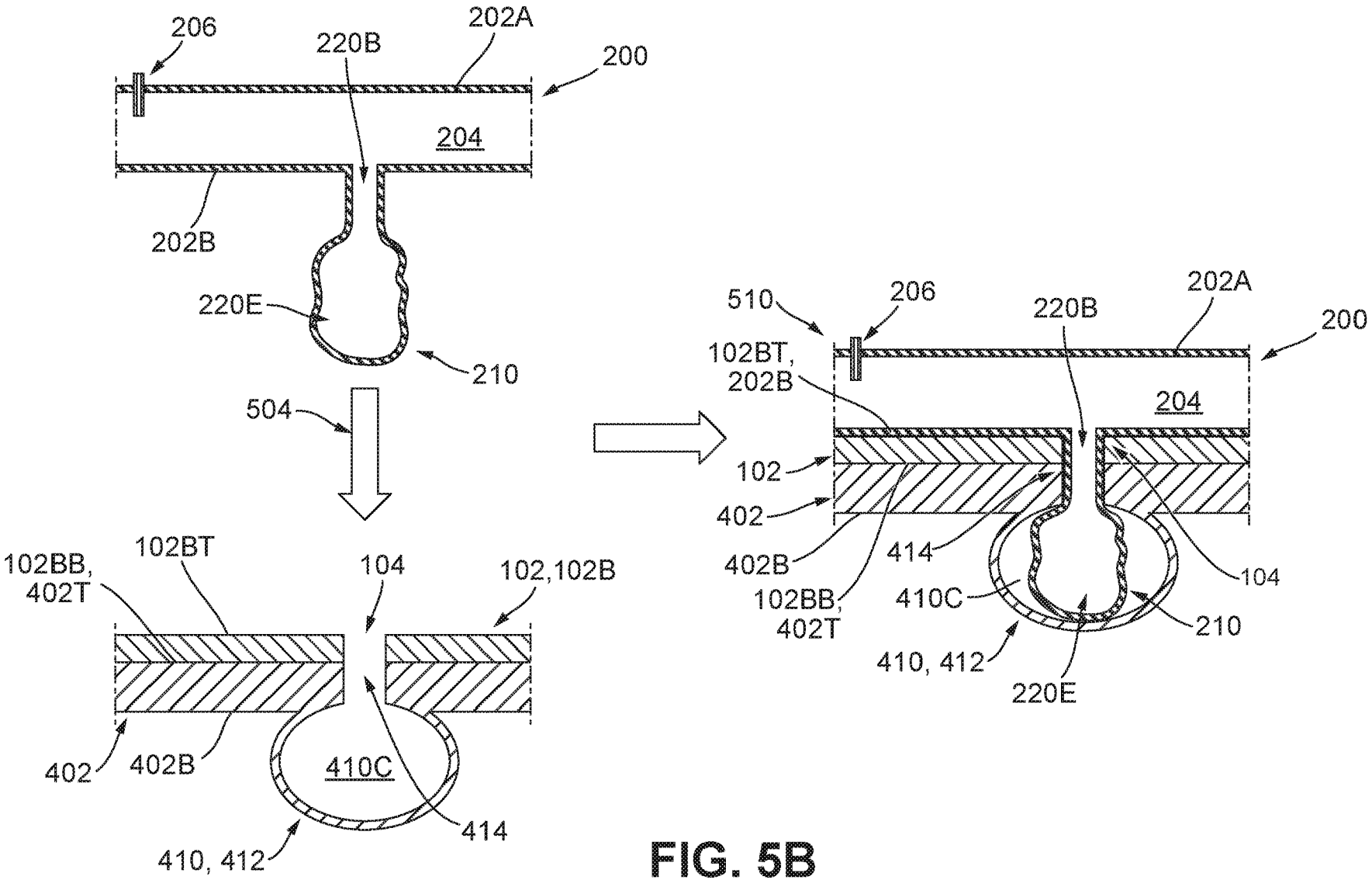

FIG. 5B illustrates another step in this example assembly process. In the step of FIG. 5B, an inflatable bladder 200 (or other impact force-attenuating component) is included in the assembly process. The inflatable bladder 200 of this example includes: (i) a first sheet 202A (e.g., a top sheet) forming a top surface for supporting at least a portion of a plantar surface of a wearer's foot (e.g., a foot support surface) and (ii) a second sheet 202B (e.g., a bottom sheet forming a base surface) opposite the first sheet 202A. A fluid chamber 204 is defined between the first sheet 202A and the second sheet 202B. The inflatable bladder 200 further includes at least one inflation port 206 through which fluid (e.g., a gas, such as air) may be introduced into the fluid chamber 204. The inflatable bladder 200 may be made from conventional materials formed in conventional manners, e.g., as are known and used in the footwear arts. Further, the first sheet 202A and the second sheet 202B may be formed from separate sheets (e.g., of thermoplastic elastomer material) or they may constitute different portions of a single sheet (e.g., parts of a larger, single sheet folded at one edge). The sheets 202A, 202B may be joined together, e.g., at a perimeter seam, for example, using heat and/or pressure, welding techniques, etc., as known and used in the footwear arts. Additionally, internal welds or seams (e.g., joining the interior surfaces of sheet 202A and sheet 202B) and/or other features (such as internal tensile elements) may be used to control the shape of the inflatable bladder 200, e.g., in manners conventionally known and used in the footwear arts.

As further shown in FIG. 5B, the inflatable bladder 200 of this example further includes a first inflatable lug 210 extending from the second sheet 202B (and extending outward from the base surface provided by the second sheet 202B). The fluid chamber 204 of this example extends continuously from the volume between the first sheet 202A and the second sheet 202B and into the interior volume defined within the first inflatable lug 210. At this stage in the process, the inflatable bladder 200 (including the inflatable lug 210) may be in an uninflated condition or a low-pressure condition, e.g., such that the surface of the inflatable lug 210 is readily collapsible and/or foldable. When a plurality of through hole openings 104, a plurality of access openings 414, and/or a plurality of receptacles 410 are provided in a footwear structure, the inflatable bladder 200 may include a corresponding plurality of inflatable lugs 210, e.g., with one inflatable lug 210 provided for each corresponding through hole opening 104, each corresponding access opening 414, and/or each corresponding receptacle 410.

In the assembly step illustrated by process arrow 504, the inflatable bladder 200 is positioned with respect to the upper component 102 and the foot support component 402 such that the first inflatable lug 210 extends into the first receptacle 410. More specifically, as illustrated in the example of FIG. 5B, the first inflatable lug 210 is positioned such that: (a) its base portion 220B extends through the first through hole opening 104 and through opening 414 of the foot support component 402 and (b) its expandable portion 220E extends into the first chamber 410C of the first receptacle 410. When present, other inflatable lugs 210 may be positioned to extend through other corresponding through hole openings 104 in the upper component 102 and into other receptacles 410 provided in the foot support component 402 in similar manners. In this manner, as illustrated in FIG. 5B, at least a portion of the upper component 102 may be sandwiched between the base surface 202B of the inflatable bladder 200 (formed by the second sheet 202B) and the first surface 402T (the top surface) of the foot support component 402. No adhesive is provided between the base surface 202B of the inflatable bladder 200 and the upward-facing surface 102BT of the upper component 102 in at least some examples of this assembly process. Reference number 510 shown in FIG. 5B refers to the combined structure of the upper component 102, the inflatable bladder 200, and the foot support component 402 assembled with the inflatable lug(s) 210 extending into corresponding receptacle(s) 410 and through corresponding through hole opening(s) 104 provided in the upper component 102.

In the assembly process described above, the upper component 102 is positioned with respect to the foot support component 402 and then the inflatable bladder 200 is positioned with respect to the combination of the upper component 102 and the foot support component 402. Other options are possible. For example, the inflatable bladder 200 could be positioned with respect to the upper component 102 (e.g., with inflatable lug(s) 210 extending through the through hole opening(s) 104 as described above in conjunction with FIGS. 3A and 3B) and then the foot support component 400 may be positioned with respect to the combination of the upper component 102 and the inflatable bladder 200 (e.g., such that the inflatable lug(s) 210 of the inflatable bladder 200 extend into corresponding receptacle(s) 410 of the foot support component 402). Additionally or alternatively, the steps of FIGS. 5A and 5B could take place simultaneously or in an alternating order (e.g., with different portions of the overall combined structure 510 assembled in different orders). Any desired manner of providing the combined structure 510 shown in FIG. 5B may be used in different examples of this technology.

Figure 5C:
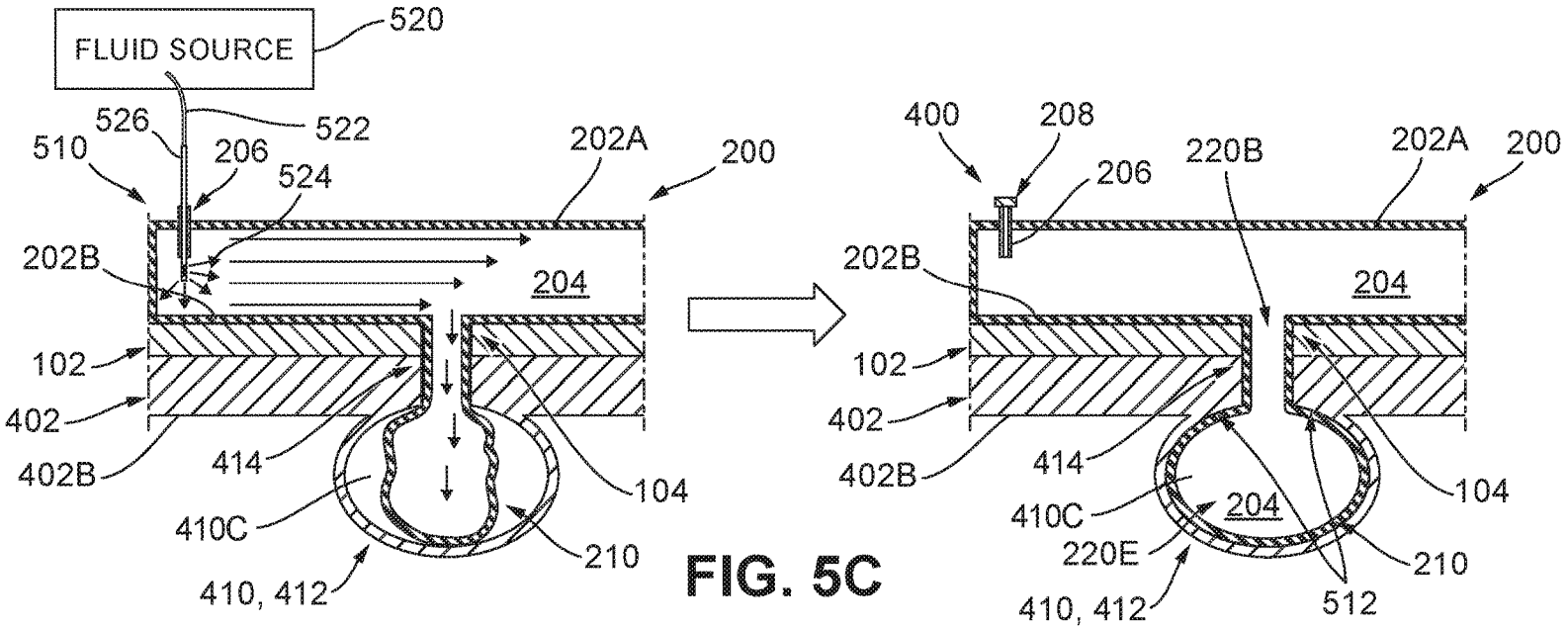

FIG. 5C shows a portion of the footwear assembly process in which the inflatable bladder 200 (or other expandable structure) is inflated by fluid 524 (e.g., gas) from a fluid source 520. FIG. 5C shows a fluid line 522 from the fluid source 520 introducing fluid 524 into the fluid chamber 204 of the inflatable bladder 200 (e.g., by an inflation needle 526 inserted into inflation port 206). This action changes the inflatable bladder 200 from an uninflated condition or a low-pressure condition (the left side of FIG. 5C) to an inflated condition or a high-pressure condition (the right side of FIG. 5C). As a result, the inflatable lug(s) 210 change in size, shape, and/or rigidity to expand within the interior chamber(s) 410C of their corresponding receptacle(s) 410, as shown at the right side of FIG. 5C. Once expanded (e.g., inflated) to the desired pressure (e.g., from 15 to 25 psi (103 kPa to 172 kPa) and/or rigidity, the inflation port(s) 206 can be sealed (e.g., crimped shut using heat and/or pressure, capped off, etc.), as shown by sealed end 208 in FIG. 5C. Once inflated with a gas (or otherwise expanded) and sealed, the first inflatable lug 210 will have a size, shape, and/or rigidity that inhibits the first inflatable lug 210 from pulling out of the first interior chamber 410C of the first receptacle 410 through the first opening 414. Thus, as shown in FIG. 5C, when expanded, the exterior surface of the expandable lug 210 bears against the top interior surface of the receptacle 410. See areas 512 in FIG. 5C. The top of the receptacle 410 forms an "undercut" or "bearing surface" that engages the expanded lug 210 surface. The interfacing lug 210 and receptacle 410 surfaces at area 512 inhibit the lug 210 from pulling out of the receptacle. Similarly, when present and inflated with a gas (or otherwise expanded) and sealed, other inflatable lugs 210 will have a size, shape, and/or rigidity that inhibits that inflatable lug 210 from pulling out of the interior chamber 410C of its corresponding receptacle 410 through the opening 414 located at the top surface 402T of the foot support component 402 (e.g., these lugs 210 and receptacles 410 may have similar interfacing surfaces and undercuts).

In this manner, as shown in FIG. 5C, the upper component 102, inflatable bladder 200, and foot support component 402 can be engaged together, optionally in a completely adhesive-free manner. Rather, the inflated lugs 210 of the inflatable bladder 200 can hold the parts together by the outer surface of the enlarged head or bulb of the inflatable lug 210 engaging the interior surface of the interior chamber 410C. Indeed, an entire footwear structure 400 could be assembled in this "adhesive-free" manner. Such structures may be well suited for disassembly (discussed in more detail below) and/or recycling of footwear parts.

In some examples of this technology, the interior surface of the interior chamber(s) 410C will define an interior chamber volume ($V_{410}$) that is substantially the same as the volume ($V_{210}$) defined by the outer surface of the inflated lug 210 located within the interior chamber 410C. In other words, once fully inflated, the inflated lug 210 may completely fill or substantially completely fill the interior chamber 410C (e.g., $V_{410}=V_{210}$ to 1.1 $V_{210}$). Alternatively, if desired, $V_{410}$ may be somewhat greater than $V_{210}$ (when fully inflated), e.g., particularly if the inflatable lug 210 is sufficiently rigid when inflated to prevent it from undesirably deforming within interior chamber 410C and pulling out of its corresponding opening 414. As another alternative, in at least some examples of this technology, a single interior chamber 410C and receptacle 410 may include multiple openings (e.g., at surface 402T) such that multiple inflatable lugs 210 may extend into a single or continuous interior chamber 410C and receptacle 410 (i.e., two or more inflatable lugs 210 may extending into a single interior chamber 410C and into a single receptacle 410). See the right side chambers 410C in FIGS. 10 and 11, discussed in more detail below.

Figure 5E:
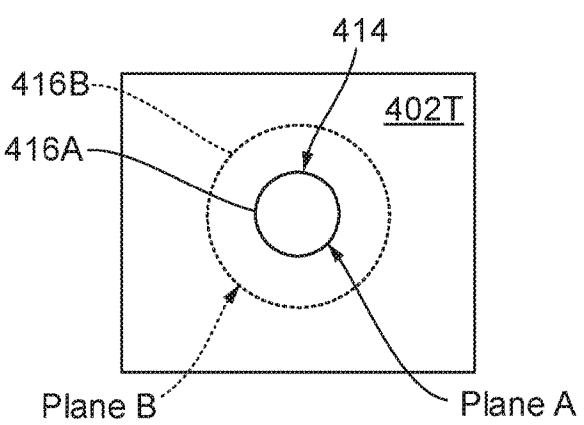
Figure 5D:
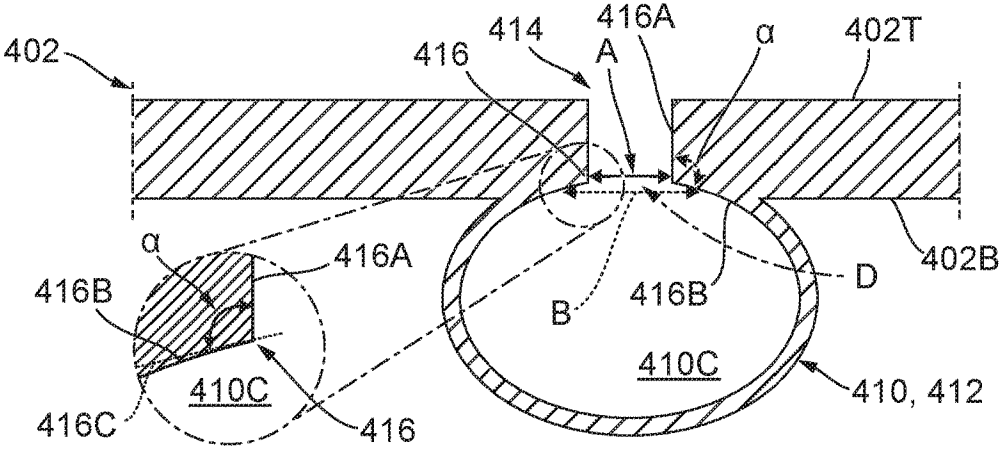

Various features of the opening 104, receptacle 410, interior chamber 410C, opening 414, and/or inflatable lug 210 may assist in securing the inflatable bladder 200 to the foot support component 402 (and thus securing these parts together and securing these parts with the upper component 102). For example, as shown in FIG. 5D, a relatively sharp corner or edge 416 may be provided at the entry to the interior chamber 410C. As some more specific examples, the corner or edge 416 may form an angle $\alpha$ of 75 degrees to 170 degrees. As shown, the angle $\alpha$ is the angle between (i) the side wall 416A of the opening 414 and (ii) an interior surface 416B of the interior chamber 410C at a location adjacent the opening 414. If either or both of these surfaces 416A and/or 416B are curved, the angle can be measured using tangents (e.g., 416C) at locations adjacent the entry to the interior chamber 410C. As additional examples, the angle α may be within a range of 75 degrees to 165 degrees, a range of 80 degrees to 160 degrees, a range of 85 degrees to 155 degrees, a range of 90 degrees to 150 degrees, a range of 80 degrees to 125 degrees, a range of 85 degrees to 120 degrees, or even within a range of 90 degrees to 120 degrees. As still other examples, the edge 416 may have a curved entry shape, e.g., having a curvature with a radius less than 10 mm, and in some examples, a curvature with a radius less than 8 mm or less than 6 mm. Further, any one or more of the above angles and/or curvature sizes may be provided in any of the foot support components 402 described in this specification and illustrated in FIGS. 1-14. In this manner, the interior surface of the interior chamber 410C (at the top) provides an enlarged "bearing surface" or "undercut" that engages the exterior surface of the inflatable lug 210 when the lug 210 is expanded. When the inflatable lug 210 is inflated to a sufficient pressure and/or is made sufficiently rigid, these interfacing and engaged surfaces of the interior chamber 410C and the inflatable lug 210 are sized and/or shaped (and/or have sufficient rigidity) to prevent the inflatable lug 210 from pulling out of the interior chamber 410C or the receptacle 410 through the opening 414. Reinforcing the opening(s) 104 in the upper component 102 (as discussed above) and/or the opening 414 of the foot support component 402 also may be used in some examples of this technology, e.g., to help prevent or inhibit undesired deforming, stretching, and/or tearing of the materials at the openings 104, 414.

Another way of defining the "undercut" provided at the entry to the interior chamber 410C is by a comparison of: (i) the area ($A_{Plane\ A}$) defined within the opening 414 at a first plane A (e.g., a plane located immediately above the entry into the chamber 410C and optionally transverse to the axial direction of the opening 414) and (ii) the area ($A_{Plane\ B}$) defined within the chamber 410C at a second plane B parallel to the first plane A and at a location spaced "D" mm from the first plane A. Note FIGS. 5D and 5E (FIG. 5E provides a view looking directly down into opening 414 from the top surface 402T of the foot support component 402 with Plane A shown the size of the opening 414 and with Plane B shown as a broken line (because it is located within the chamber 410C below the opening 414)). In at least some examples of this technology, with a parallel plane spacing distance D of 5 mm, the area of Plane A ($A_{Plane\ A}$) within the opening 414 may compare to the area of Plane B ($A_{Plane\ B}$) within the interior chamber 410C under any one or more of the following relationships:

| | | |
|---|---|---|
| $A_{Plane\ B} \geq 1.25 \times A_{Plane\ A}$ | $A_{Plane\ B} \geq 1.5 \times A_{Plane\ A}$ | $A_{Plane\ B} \geq 1.75 \times A_{Plane\ A}$ |
| $A_{Plane\ B} \geq 2 \times A_{Plane\ A}$ | $A_{Plane\ B} \geq 4 \times A_{Plane\ A}$ | $A_{Plane\ B} \geq 8 \times A_{Plane\ A}$ |
| $A_{Plane\ B} \geq 10 \times A_{Plane\ A}$ | $A_{Plane\ B} \geq 12 \times A_{Plane\ A}$ | $A_{Plane\ B} \geq 15 \times A_{Plane\ A}$ |
| $100 \times A_{Plane\ A} \geq A_{Plane\ B} \geq 1.25 \times A_{Plane\ A}$ | $80 \times A_{Plane\ A} \geq A_{Plane\ B} \geq 1.25 \times A_{Plane\ A}$ | |
| $60 \times A_{Plane\ A} \geq A_{Plane\ B} \geq 1.25 \times A_{Plane\ A}$ | $40 \times A_{Plane\ A} \geq A_{Plane\ B} \geq 1.25 \times A_{Plane\ A}$ | |
| $100 \times A_{Plane\ A} \geq A_{Plane\ B} \geq 2 \times A_{Plane\ A}$ | $80 \times A_{Plane\ A} \geq A_{Plane\ B} \geq 4 \times A_{Plane\ A}$ | |
| $60 \times A_{Plane\ A} \geq A_{Plane\ B} \geq 8 \times A_{Plane\ A}$ | $40 \times A_{Plane\ A} \geq A_{Plane\ B} \geq 10 \times A_{Plane\ A}$ | |

Any one or more of the above noted Plane A and Plane B relationships also may be provided at Planes A and B having a parallel plane spacing distance D of 4 mm, 3 mm, 2 mm, 6 mm, 8 mm, 10 mm, and/or 12 mm. Further, any one or more of the above relationships may be provided in any of the foot support components 402 described in this specification and illustrated in FIGS. 1-14.

In the example structures shown in FIGS. 4-5D, the ground-facing surface (e.g., surface 402B) of the foot support component 402 located opposite the first (e.g., top) surface 402T may form a surface for directly contacting the ground in use (the term "ground" as used herein in this context means any contact surface, indoor or outdoor). In such structures, the ground-facing surface may be formed to include one or more ground-facing and/or ground-engaging lugs 412 that at least partially enclose the first interior chamber 410C of the receptacle 410. If desired, a separate ground-facing and/or ground-engaging lug 412 may be provided for each interior chamber 410C and/or receptacle 410 (e.g., as shown in FIG. 4).

In some examples of this technology, however, at least one, some, or even all of the ground-facing lugs 412 of a foot support component 402 may be at least partially enclosed in another sole component 600, such as an outsole component 600 (e.g., formed using conventional footwear sole materials and conventional outsole production techniques). Note FIG. 6. Sole component 600 of this example includes an interior chamber 602 or recess, e.g., sized and shaped to at least partially contain one or more receptacles 410. The bottom surface 600B of the sole component 600 may include traction-enhancing structures, such as ridges, grooves, treads, lugs, spikes, cleats, etc., including traction-enhancing structures that are conventionally known and used in the footwear arts. The sole component 600 may be engaged with the foot support component 402 (and/or other footwear component) in any desired manner, including by adhesives, by mechanical fasteners, by sewn seams, etc. In some examples of this technology, the sole component 600 will be engaged in an adhesive free manner and/or in a detachable manner, such as by sewn seams or mechanical fasteners, e.g., to facilitate disassembly and/or recycling.

Figure 7:
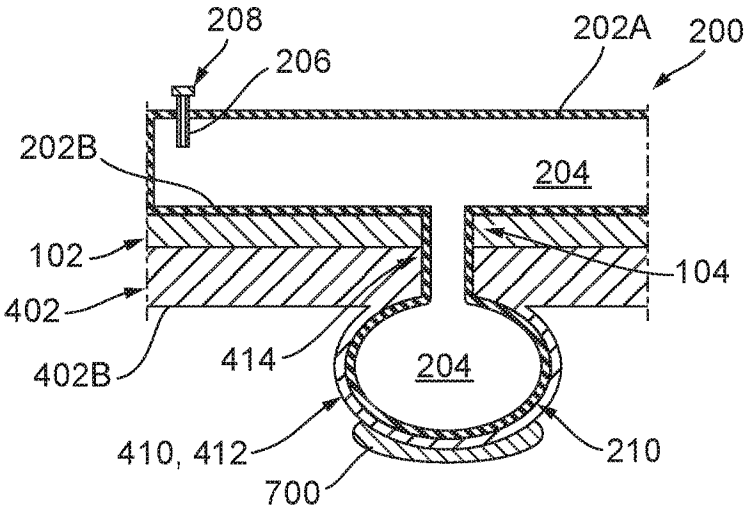
FIGS. 6 and 7 illustrate example footwear structures including additional component parts in accordance with some aspects of this technology.
Figure 6:
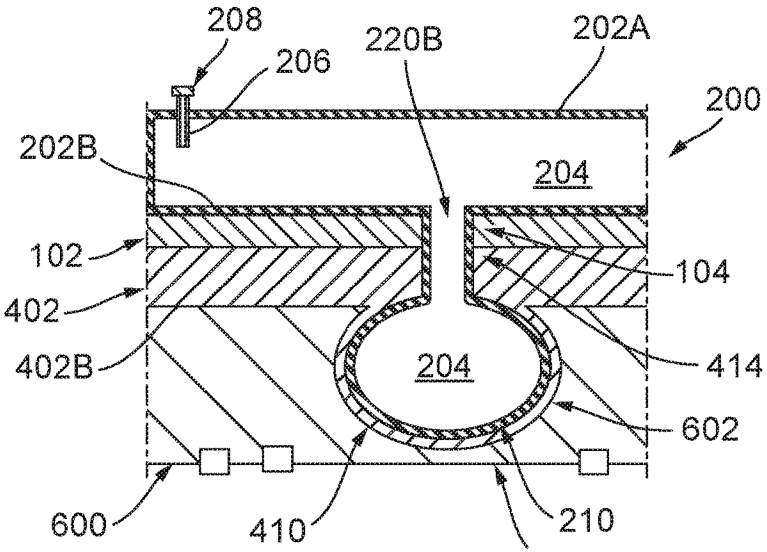

FIG. 7 illustrates a portion of an assembled article of footwear 400 similar to that described above in conjunction with FIGS. 1A-5E in which the outer surface of one or more receptacles 410 forms an exposed, ground-facing lug 412. In this example footwear 400 structure, however, an additional protective element 700 (e.g., outsole element 700) is engaged with the bottom exterior surface of the ground-facing lug 412. This additional protective element 700 may be made from conventional outsole material(s) and provides some additional protection (e.g., durability, puncture resistance, abrasion resistance, etc.) for the ground-facing lug 412. Any one or more of the ground-facing lugs 412 (such as any one or more of the ground-facing lugs 412 shown in FIG. 4) may include an additional protective element 700 of the type shown in FIG. 7. The additional protective element(s) 700 may be engaged with the foot support component 402 in any desired manner, including by adhesives, by mechanical fasteners, by sewn seams, etc. In some examples of this technology, the additional component 700 will be engaged in an adhesive free manner and/or in a detachable manner, e.g., to facilitate disassembly and/or recycling.

Figure 8:
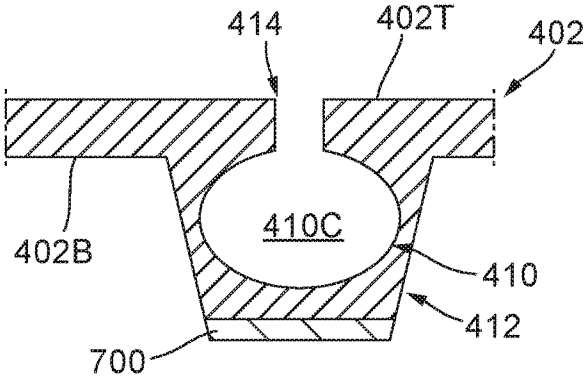

FIG. 8 provides a cross sectional view through a receptacle 410 of another example foot support component 402 having one or more receptacles 410 formed therein. In the example of FIG. 8, however, the exterior surface of the ground-facing lug 412 is formed more in the conventional shape of a traction-enhancing component for a footwear sole structure, such as a cleat or other sole component. Thus, the exterior surface of the ground-facing lug 412 need not correspond to the shape of the interior chamber 410C of the receptacle 410 formed in the ground-facing lug 412. This enables the ground-facing lug 412 to be sized and shaped as needed to provide the desired traction, durability, and/or other performance characteristics while also adequately protecting the inflatable lug 210 of the inflatable bladder 200 housed within the receptacle 410. While not a requirement, FIG. 8 illustrates an additional protective component 700 (e.g., an outsole element) engaged with the bottom of the ground-facing lug 412 (e.g., in the manners described above for element 700 in FIG. 7).

Figure 9:
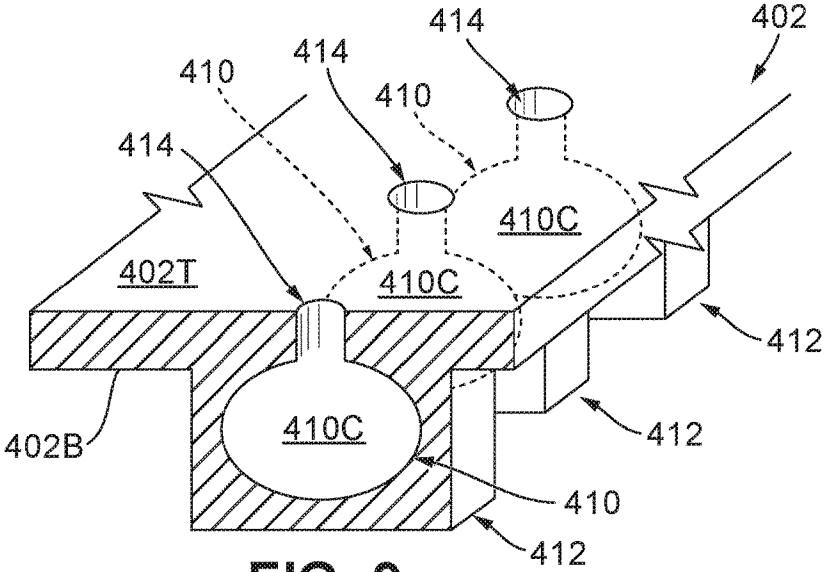
FIGS. 8-11 illustrate additional and/or alternative features of foot support components in accordance with some aspects of this technology.

Similar to the structure shown in FIG. 4, FIG. 9 illustrates the top surface 402T of an example foot support component 402 having multiple openings 414 extending to multiple interior chambers 410C and receptacles 410. In this illustrated example, each illustrated receptacle 410 has its own separate ground-facing lug 412, but all of the ground-facing lugs 412 connect to or extend from a common base (that forms top surface or upper-facing surface 402T and bottom surface or ground-facing surface 402B). While not shown in FIG. 9, one or more of the ground-facing lugs 412 may include a protective element, such as protective component 700 shown in FIGS. 7 and 8.

Figure 10:
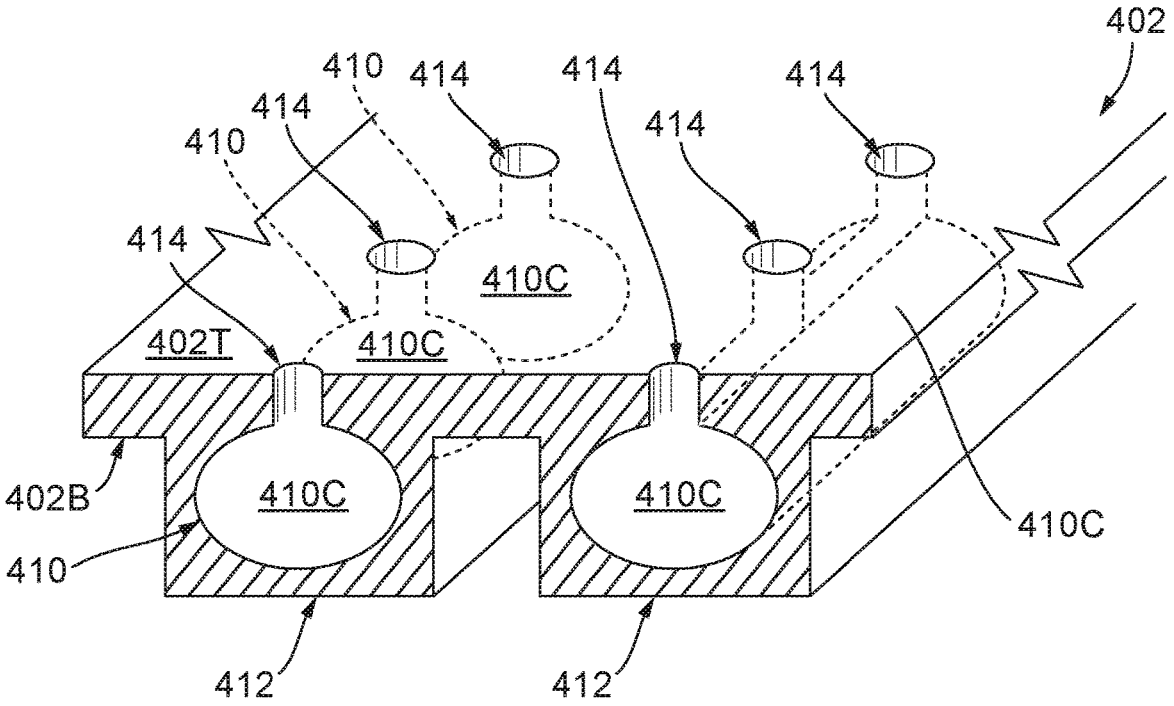
Figure 11:
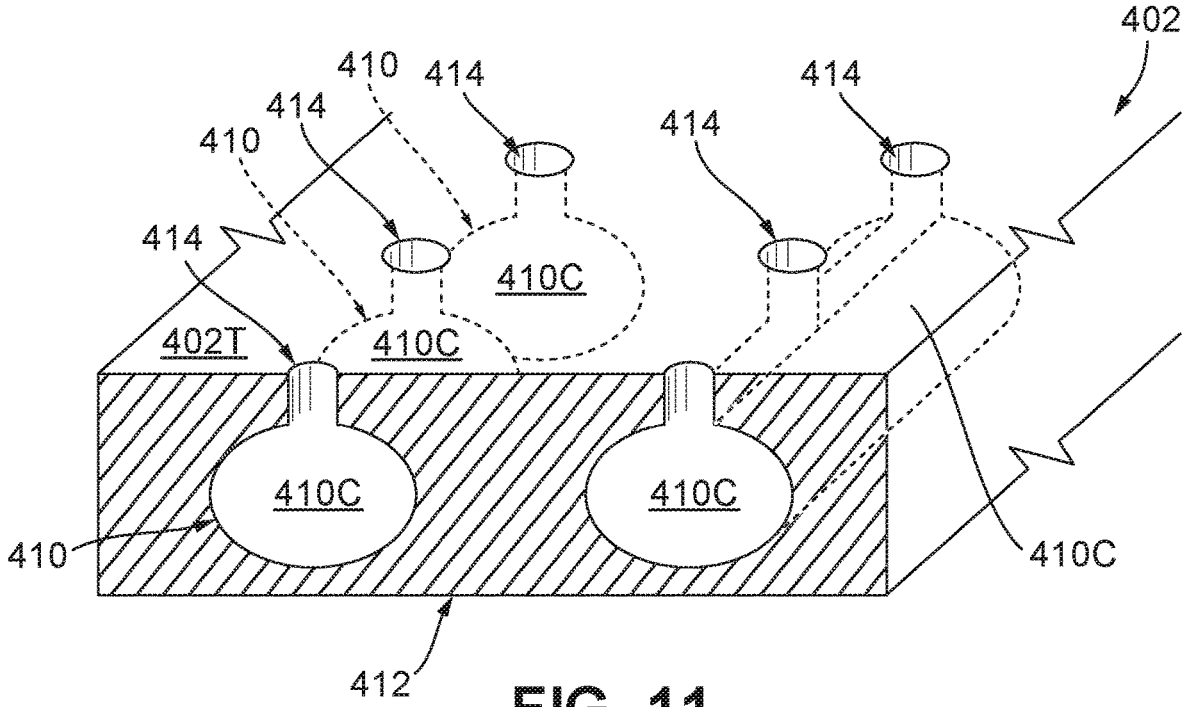

FIGS. 10 and 11 show additional examples of foot support components 402 in which a single ground-facing lug 412 includes two or more receptacles 410, two or more interior chambers 410C, and/or two or more openings 414 at the upper-facing surface 402T providing access to the receptacle(s) 410 and/or interior chamber(s) 410C. Thus, as shown in the examples at the left sides of FIGS. 10 and 11, each opening 414 may include its own and a separate receptacle 410 and interior chamber 410C. Alternatively, in some examples of this technology, two or more of openings 414 at the upper-facing surface 402T may open into a single receptacle 410 and interior chamber 410C, e.g., as shown on the right sides of FIGS. 10 and 11.

Figure 12:
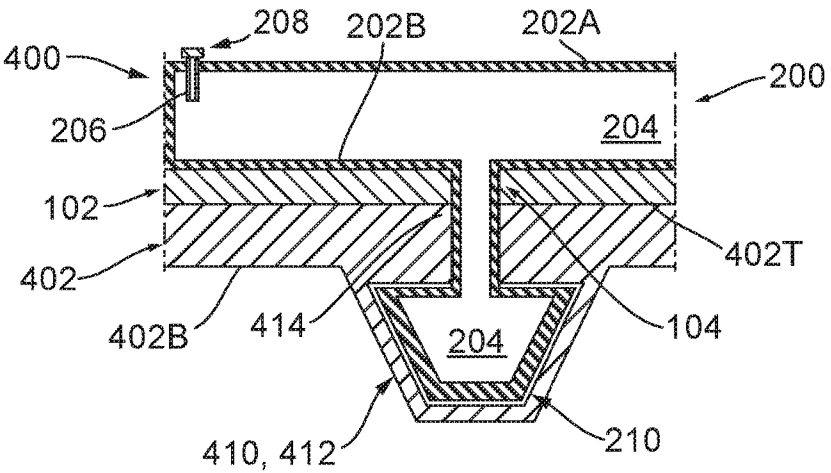
FIG. 12 illustrates another example footwear structure in accordance with some aspects of this technology.

FIG. 12 illustrates an article of footwear 400 structure similar to that shown in FIGS. 1-5E except the ground-facing lug 412 and the receptacle 410/interior chamber 410C have more of a frusto-conical shape. Thus, the inflatable lug 210, when inflated, also takes on a more frusto-conical shape. The footwear structure 400 of FIG. 12 may include any of the alternative and/or additional features described above in conjunction with FIGS. 1-11, such as additional outsole components 600, additional protective components 700, one-to-one inflatable lug 210 to receptacle 410 ratio, two or more inflatable lugs 210 extending into a single receptacle 410, additional reinforcements, etc. The component parts shown in FIG. 12 may be engaged together in an adhesive-free manner, e.g., using engagement supplied only by the inflated lugs 210 within the receptacle(s) 410.

Figure 13:
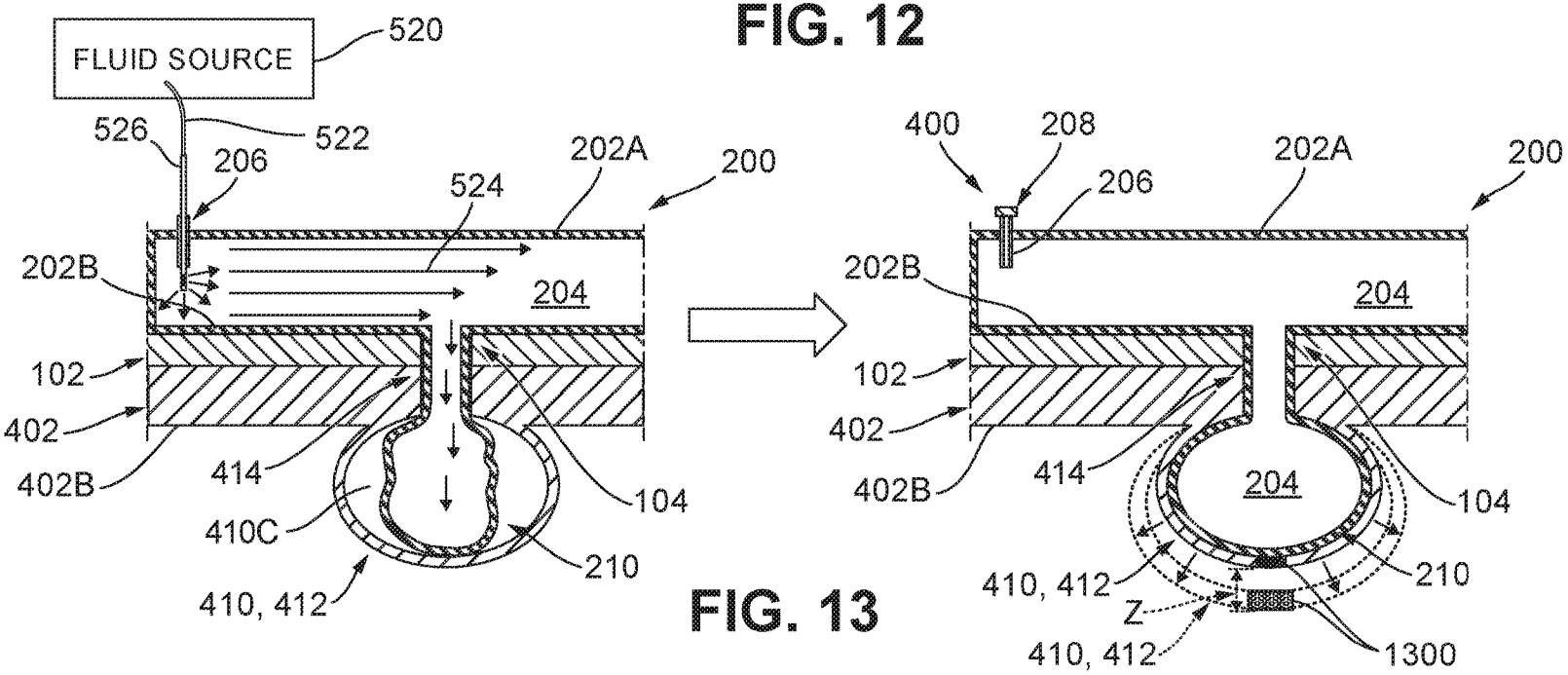
FIG. 13 illustrates another example footwear structure in accordance with some aspects of this technology in which a ground-facing lug of the foot support component expands under inflation force.

FIG. 13 illustrates example features in accordance with another aspect of this technology. FIG. 13 illustrates the step of inflating the bladder 200, e.g., similar to that shown in FIG. 5C. In the example of FIG. 13, however, inflation of the inflatable lug 210 applies an outward force on the interior surface of the receptacle 410 such that the receptacle 410 also expands in size somewhat, as shown by the broken lines on the right hand side of FIG. 13. This feature may provide a visual indicator of the inflation of the inflatable lugs 210, which are not visible from the exterior of the article of footwear 400. If desired, the outer surface of the ground-facing lug 412 and/or the receptacle 410 may include expansion supporting features, such as folds, bellows, or the like, and/or may be made at least in part from a stretchable material (such as a thermoplastic side wall or panel). Such expansion supporting features are shown by component 1300 in FIG. 13 (e.g., with reference number 1300 generally representing folds, bellows, or stretchable material). Any of the other features described above for FIGS. 1-12 also may be included with or applied to structures of the types shown in FIG. 13 and/or the expansion support feature(s) of FIG. 13 may be applied to any of the structures shown and described above for FIGS. 1-12. Additionally or alternatively, in some examples, when expanded, the bottom-most extent of the lug(s) 412 may displace a distance Z of at least 2 mm. As additional examples, distance Z may be at least one or more of: at least 3 mm; at least 4 mm; at least 5 mm; between 2 mm and 12 mm; between 2 mm and 10 mm; between 2 mm and 8 mm; between 3 mm and 12 mm; between 3 mm and 10 mm; and/or between 3 mm and 8 mm.

While the outer surface(s) of one or more ground-facing lugs 412 may expand any desired amount without departing from this technology, in some examples of this technology, the expanded lug volume ($V_{EXP}$) of ground-facing lug 412 as compared to the initial and unexpanded lug volume ($V_{INIT}$) of ground-facing lug 412 may correspond to one or more of the following relationships:

| | | |
|---|---|---|
| $V_{EXP} \geq 1.05 \times V_{INIT}$ | $V_{EXP} \geq 1.1 \times V_{INIT}$ | $V_{EXP} \geq 1.2 \times V_{INIT}$ |
| $2.5 \times V_{INIT} \geq V_{EXP} \geq 1.05 \times V_{INIT}$ | $2 \times V_{INIT} \geq V_{EXP} \geq 1.1 \times V_{INIT}$ | |

Additionally or alternatively, in some examples of this technology, the exterior surface area of the expanded of ground-facing lug 412 ($A_{EXP}$) as compared to the initial and unexpanded exterior surface area of ground-facing lug 412 ($A_{INIT}$) may correspond to one or more of the following relationships:

| | | |
|---|---|---|
| $A_{EXP} \geq 1.05 \times A_{INIT}$ | $A_{EXP} \geq 1.1 \times A_{INIT}$ | $A_{EXP} \geq 1.2 \times A_{INIT}$ |
| $2.5 \times A_{INIT} \geq A_{EXP} \geq 1.05 \times A_{INIT}$ | $2 \times A_{INIT} \geq A_{EXP} \geq 1.1 \times A_{INIT}$. | |

As described above, in accordance with at least some aspects of this technology, a footwear 400 structure may be assembled (at least in part) in an adhesive-free manner, e.g., using one or more inflatable lugs 210 of a foot supporting inflatable bladder 200 to engage one or more receptacles 410 provided in a foot support component 402, such as a footwear midsole or outsole component. Optionally, the one or more inflatable lugs 210 may extend through one or more through hole openings 104 of an upper component 102 to further engage the upper component 102 in the footwear 400 structure in an adhesive-free manner. Avoiding use of adhesives generally enhances the recyclability of the footwear parts, as it eases the disassembly process and avoids contaminating the materials to be recycled with adhesive materials. Further, avoiding the use of adhesive during assembly improves the sustainability and environmentally friendly nature of the product and production by reducing use of volatile chemicals.

Figure 14:
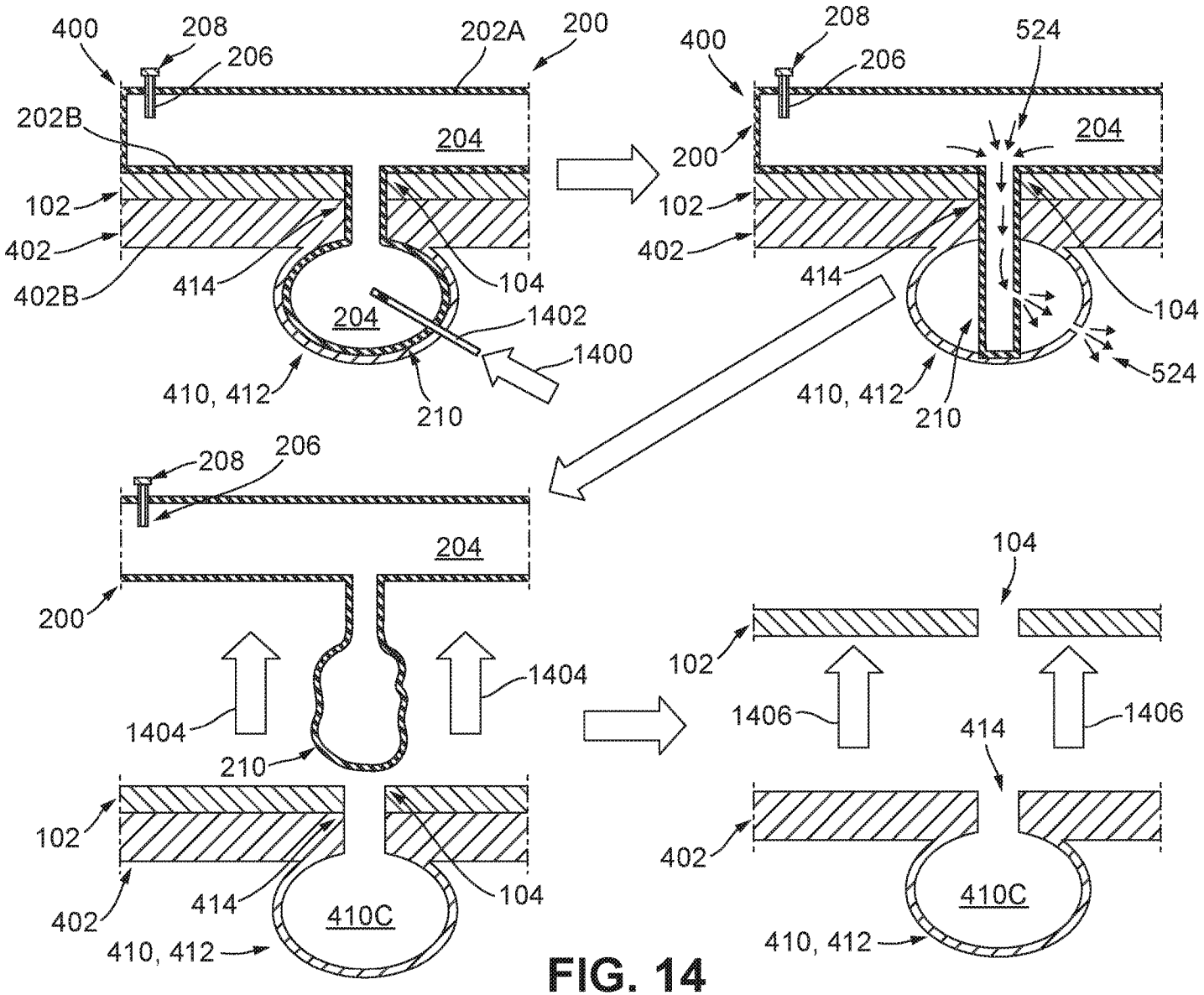
FIG. 14 illustrates an example disassembly process in accordance with some aspects of this technology.

FIG. 14 illustrates an example process for disassembling an article of footwear 400 in accordance with some aspects of this technology. The process begins with a completed article of footwear 400, e.g., of any of the types described above in conjunction with FIGS. 1-13. Then, as shown by process arrow 1400 in FIG. 14, the process begins by releasing fluid from the sealed fluid chamber 204 in any desired manner, e.g., by puncturing a fluid-filled bladder 200, by opening a valve (if present), by opening sealed end 208, etc. While FIG. 14 shows a sharp element 1402 piercing the inflated lug 210, the sealed fluid chamber 204 could be punctured at any location and/or fluid could be released through a valve or other port 206 provided with the inflatable bladder 200. This action releases fluid 524 from the fluid chamber 204 thereby deflating the inflated lug 210. See the top, right-hand side of FIG. 14.

Once the inflated lug 210 is deflated, the absence of adhesive (when not used) allows the footwear parts to be readily pulled apart, e.g., as shown at the bottom of FIG. 14. For example, because the inflatable lug(s) 210 is (are) no longer expanded, it can be pulled out of the receptacle(s) 410 through the opening 414. See process arrows 1404. This allows the inflatable bladder 200 to be completely removed from the remaining footwear components. Due to the absence of adhesive on the surfaces of the inflatable bladder 200, the bladder 200 (e.g., made from thermoplastic elastomer materials) may be well suited for reuse in a new shoe (e.g., after cleaning and/or other processing) and/or well suited for use in recycling processes, e.g., in which the bladder 200 may be reprocessed and made into a new bladder, other footwear components, and/or other products.

Also, as shown at the bottom right-hand side of FIG. 14, the absence of adhesive (when not used) allows the upper component 102 to be separated from the foot support component 402. See process arrows 1406. In this manner, the foot support component 402 (e.g., made from a rubber or thermoplastic material) may be well suited for use in a new shoe (e.g., after cleaning and/or other processing) and/or well suited for use in recycling processes, e.g., in which the foot support component 402 may be reprocessed and made into a new foot support component, other footwear components, and/or other products. Similarly, the upper component 102 (e.g., a fabric component, a textile, a plastic component, etc.) may be cleaned for use in a new shoe (e.g., after cleaning and/or other processing) and/or well suited for use in recycling processes, e.g., in which the upper component 102 may be reprocessed and made into a new footwear upper component, other footwear components, and/or other products.

The expandable lugs 210 and the receptacle(s) 410 into which they are received may vary widely in aspects of this technology. Further, all expandable lugs 210 and/or receptacles 410 present in a single article of footwear and/or sole structure need not have the same size and/or shape. Different expandable lug 210 and/or receptacle 410 sizes, shapes, geometries, and/or arrangements may be provided in different areas of a sole structure. As some more specific examples, lug(s) 210 and/or receptacle(s) 410 may differ in size, shape, geometry, and/or arrangement: (i) in the heel region as compared to the midfoot region, (ii) in the heel region as compared to the forefoot region, (iii) in the midfoot region as compared to the heel region, (iv) at the lateral side (in any one or more regions) as compared to the medial size (in any one or more regions), and the like.

Figure 15A:
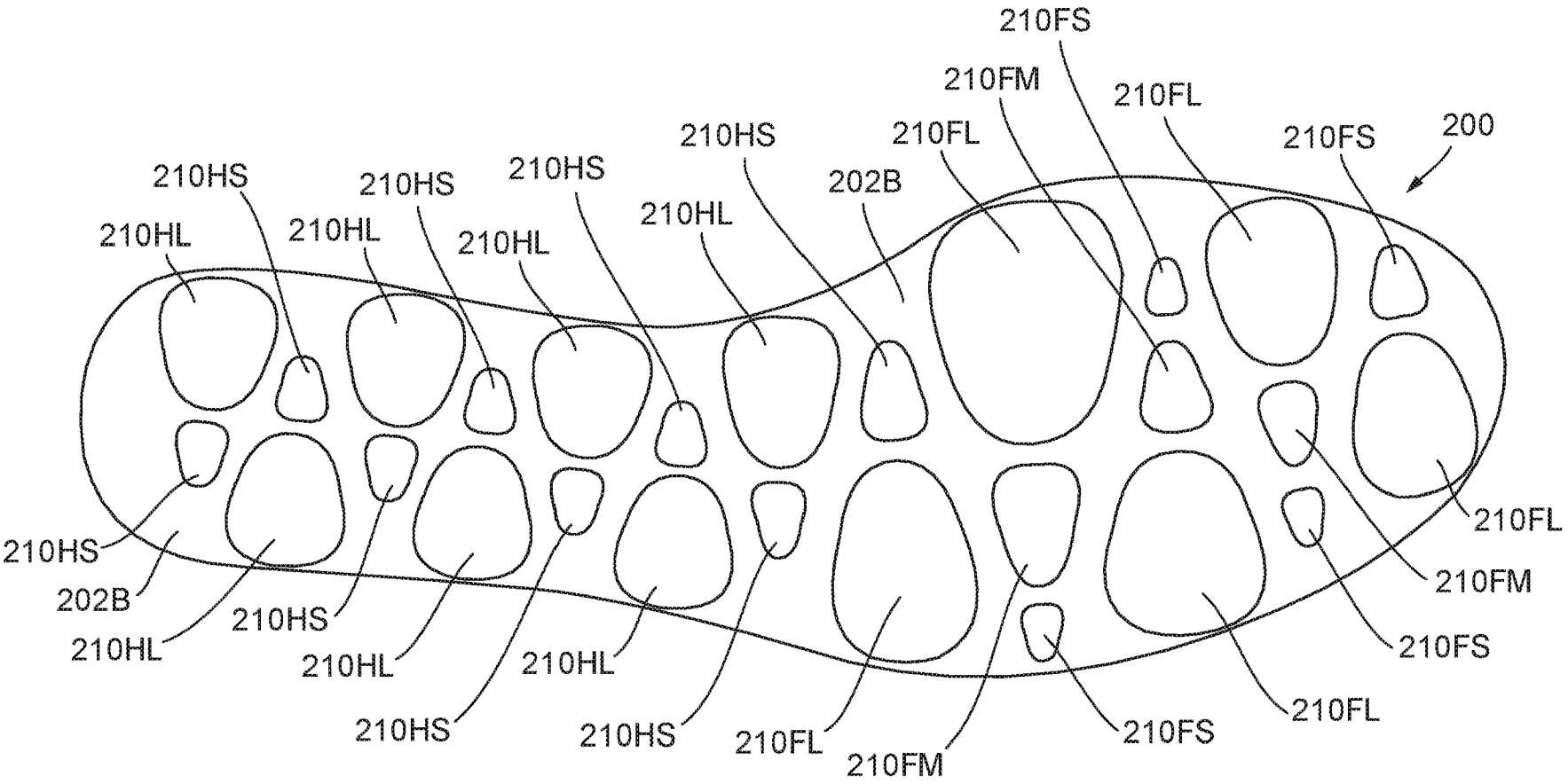
FIGS. 15A-15C illustrate additional example footwear components and features in accordance with some aspects of this technology.
Figure 15B:
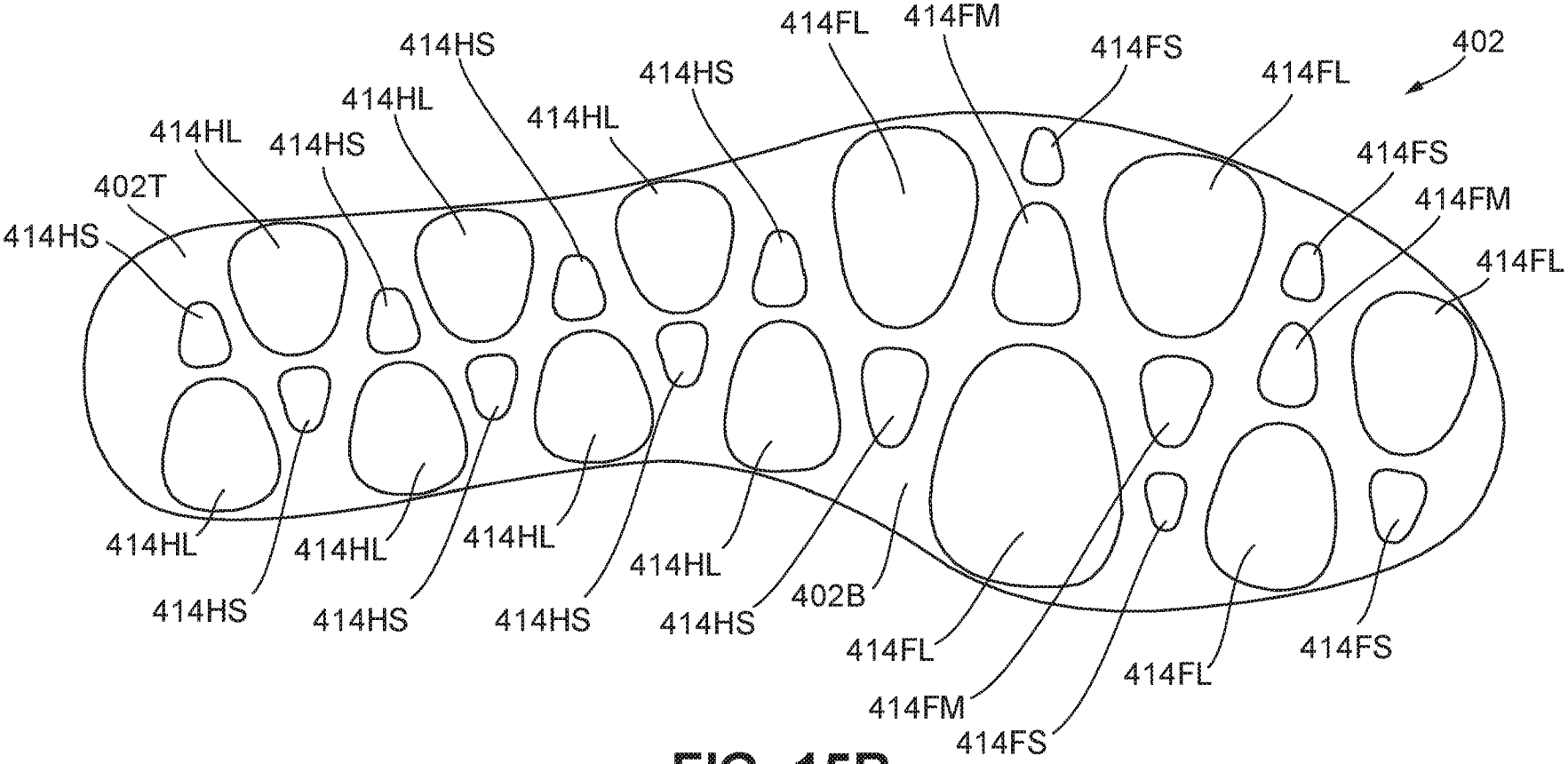
Figure 15C:
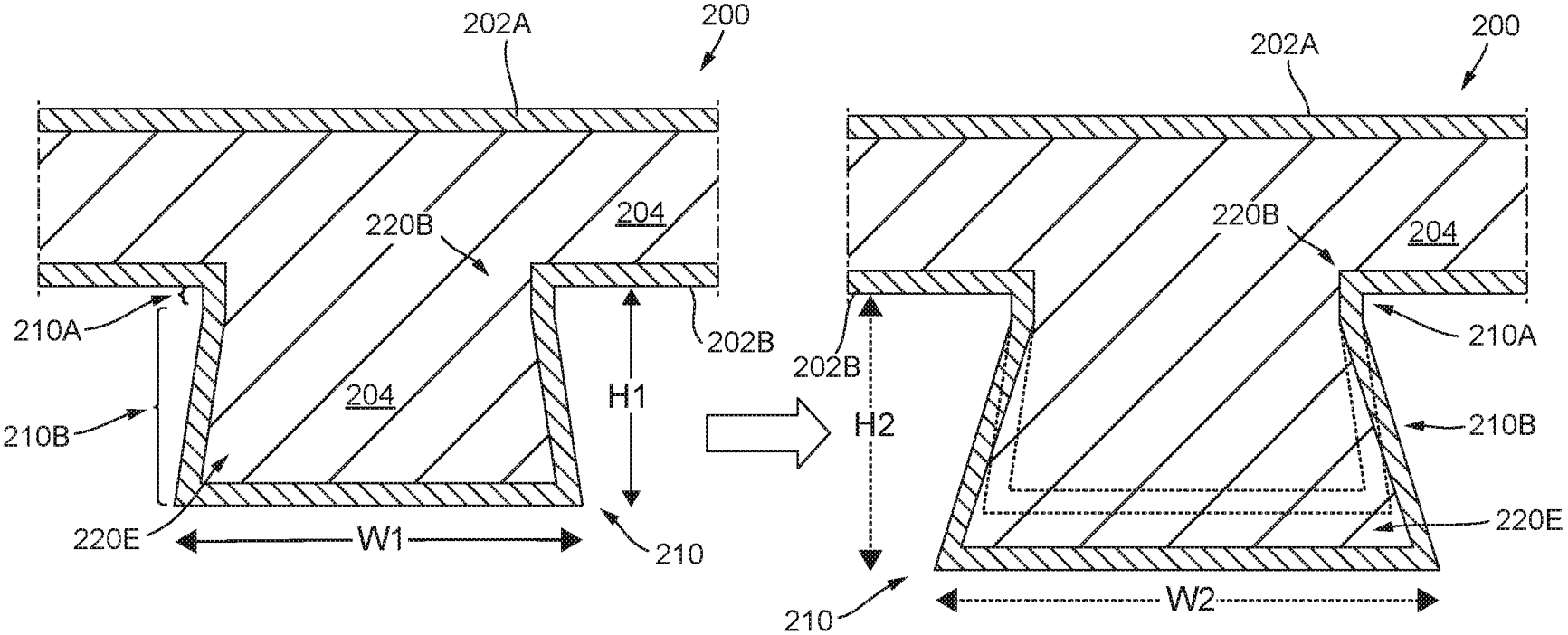

FIGS. 15A-15C show some additional specific examples. Where the same reference numbers are used in FIGS. 15A-15C as used in other figures, the same or similar parts are being referenced (including any of the options, alternatives, and the like for these same or similar parts), and much of the duplicative description thereof may be omitted.

FIG. 15A shows a bottom view of an expandable component (e.g., an inflatable bladder) 200 having a plurality of expandable lugs 210 of varying sizes and shapes extending downward from the base surface 202B. The heel region and at least some of the midfoot region of this illustrated example include relatively small expandable lugs 210HS and relatively large sized expandable lugs 210HL. While the expandable lugs may be arranged in a wide range of configurations, in the heel region and/or at least part of the midfoot region in this illustrated example, the expandable lugs are arranged in an alternating manner. For example: (a) in the side-to-side direction, a small expandable lug 210HS is arranged next to a large expandable lug 210HL, (b) in the heel-to-toe direction, a small expandable lug 210HS is arranged between two large expandable lugs 210HL, and/or (c) a large expandable lug 210HL is arranged between two small expandable lugs 210HS.

The forefoot region of this example includes expandable lugs having three general sizes, namely: relatively small expandable lugs 210FS, relatively midsize expandable lugs 210FM, and relatively large expandable lugs 210FL. While again the expandable lugs may be arranged in a wide range of configurations, in this illustrated example, in the forefoot region, where space permits, the three differently sized expandable lugs are arranged generally aligned in the side-to-side direction with increasing size in the medial side-to-lateral side direction and/or with decreasing size in the medial side-to-lateral side direction. As generally shown in FIG. 15A, the relatively large size expandable lugs 210FL may be separated from one another by either or both of the relatively small expandable lugs 210FS and/or the relatively midsize expandable lugs 210FM.

FIG. 15B illustrates a top surface 402T of a foot support component 402 configured to engage the expandable lugs of expandable component 200 shown in FIG. 15A. Thus, the top view of FIG. 15B shows openings 414HL, 414HS, 414FS, 414FM, and 414FL of various different sizes provided to receive corresponding expandable lugs 210HL, 210HS, 210FS, 210FM, and 210FL, respectively, discussed above. The openings 414HL, 414HS, 414FS, 414FM, and 414FL provide access to one or more interior chambers 410C of receptacles 410 in foot support component 402, e.g., of the types described in detail above. In at least some examples of this technology, a footwear upper component (e.g., like component 102 discussed above) could be provided to be positioned between the bottom base surface 202B of the expandable component (e.g., inflatable bladder) 200 shown in FIG. 15A and the top surface 402T of the foot support component 402 shown in FIG. 15B. Such a footwear upper component 102 may include one or more parts (e.g., fabric component(s)) having through holes (e.g., like holes 104) having the general layout and arrangement show in FIG. 15B (e.g., to axially align or overlap with one or more of openings 414HL, 414HS, 414FS, 414FM, and 414FL).

FIG. 15C shows an enlarged view of an example expandable lug 210, e.g., of the types shown in FIG. 15A, in a deflated or low-pressure configuration (the left side) and in an inflated or high-pressure configuration (the left side). As shown in this example, the portion 210A of the expandable lug 210 located closest to and extending away from the base surface 202B may extend substantially straight away from the base surface 202B. This expandable lug 210 top portion 210A may extend away from the bottom base surface 202B at an angle of about 90 degrees (e.g., 90 degrees ±10 degrees, and in some examples, 90 degrees±5 degrees). This top portion 210A may form the base portion 220B of the expandable lug 210 discussed above. Also, this top portion 210A may form an exterior surface of the expandable lug 210 that may directly engage (e.g., directly contact) the side surfaces of the holes 104 in the footwear upper component 102 (when present) and/or the openings 414 of the foot support component 402.

An expandable portion 210B of the expandable lug 210 extends downward from (in the arrangement show in FIG. 15C) and is located below the top portion 210A. This expandable portion 210B forms the expandable securing portion 220E of the expandable lug 210 discussed above. In the example of FIG. 15C, the expandable portion 210B is generally trapezoidally shaped in cross-section, although other shapes are possible (e.g., having more outwardly bulging sidewalls, having more rounded corners, etc.).

In at least some examples of this technology, inflation of an expandable lug 210 (including any of the expandable/inflatable lugs 210 shown in FIGS. 2-3B, 5B, 5C, 6, 7, 12, 13, and 15A) may cause a dimensional change to one or more dimensions of the lug 210. The left side of FIG. 15C shows this example expandable lug 210 in a low-pressure or uninflated condition having a lug height dimension H1 and a lug width dimension W1 (e.g., any dimension directly across the expandable lug 210, such as a diameter or chord dimension). The right side of FIG. 15C shows the same example expandable lug 210 in a high-pressure or inflated condition (e.g., optionally after having been inserted into a receptacle 410 of a foot support component 402 and/or through an opening 104 in an upper component 102 as described above). In the high-pressure or inflated condition, the expandable/inflatable lug 210 may increase its lug height dimension to H2 and/or its lug width dimension to W2, wherein H2>H1 and/or W2>W1. The broken lines on the right side of FIG. 15C show the original expandable/inflatable lug 210 dimensions H1 and W1.

As some more specific examples, H1, H2, W1, and W2 (in any of the expandable/inflatable lugs 210 shown in FIGS. 2-3B, 5B, 5C, 6, 7, 12, 13, and 15A) may have any one or more of the following properties:

| | | | |
|---|---|---|---|
| $W2 \geq 1.05 \times W1$ | $W2 \geq 1.1 \times W1$ | $W2 \geq 1.15 \times W1$ | $W2 \geq 1.2 \times W1$ |
| $2 \times W1 \geq W2 \geq 1.05 \times W1$ | $1.75 \times W1 \geq W2 \geq 1.1 \times W1$ | $1.5 \times W1 \geq W2 \geq 1.15 \times W1$ | |
| $H2 \geq 1.05 \times H1$ | $H2 \geq 1.1 \times H1$ | $H2 \geq 1.15 \times H1$ | $H2 \geq 1.2 \times H1$ |
| $2 \times H1 \geq H2 \geq 1.05 \times H1$ | $1.75 \times H1 \geq H2 \geq 1.1 \times H1$ | $1.5 \times H1 \geq H2 \geq 1.15 \times H1$ | |

Additionally or alternatively, in at least some examples of this technology, W2 may be at least 2 mm greater than W1, and in some examples, at least 3 mm greater, at least 4 mm greater, at least 5 mm greater, at least 7.5 mm greater, at least 10 mm greater, or even at least 12.5 mm greater. Additionally or alternatively, in at least some examples of this technology, H2 may be at least 2 mm greater than H1, and in some examples, at least 3 mm greater, at least 4 mm greater, at least 5 mm greater, at least 7.5 mm greater, at least 10 mm greater, or even at least 12.5 mm greater.

While the outer surface(s) of one or more expandable/inflatable lugs 210 may expand any desired amount without departing from this technology, in some examples of this technology (including in any of the expandable/inflatable lugs 210 shown in FIGS. 2-3B, 5B, 5C, 6, 7, 12, 13, and 15A), the expanded lug volume ($V_{EXP}$) of expandable/inflatable lug 210 as compared to the initial and unexpanded lug volume ($V_{NIT}$) of expandable/inflatable lug 210 may correspond to one or more of the following relationships:

| | | |
|---|---|---|
| $V_{EXP} \geq 1.025 \times V_{INIT}$ | $V_{EXP} \geq 1.05 \times V_{INIT}$ | $V_{EXP} \geq 1.075 \times V_{INIT}$ |
| $V_{EXP} \geq 1.1 \times V_{INIT}$ | $2 \times V_{INIT} \geq V_{EXP} \geq 1.025 \times V_{INIT}$ | |
| $1.75 \times V_{INIT} \geq V_{EXP} \geq 1.05 \times V_{INIT}$ | | |

Additionally or alternatively, in some examples of this technology, the exterior surface area of the expanded lug 210 ($A_{EXP}$) as compared to the initial and unexpanded exterior surface area of the lug 210 ($A_{INIT}$) may correspond to one or more of the following relationships:

| | | |
|---|---|---|
| $A_{EXP} \geq 1.025 \times A_{INIT}$ | $A_{EXP} \geq 1.05 \times A_{INIT}$ | $A_{EXP} \geq 1.075 \times A_{INIT}$ |
| $A_{EXP} \geq 1.1 \times A_{INIT}$ | $2 \times A_{INIT} \geq A_{EXP} \geq 1.025 \times A_{INIT}$ | |
| $1.75 \times A_{INIT} \geq A_{EXP} \geq 1.05 \times A_{INIT}$. | | |

Further, in accordance with some at least aspects of this technology, one or more of the upper component 102, the inflatable bladder 200, and/or the foot support component 402 may itself be formed from a single material and/or as a unitary, one-piece construction. These features, when present, can enhance the recyclability of the parts, e.g., after the initial useful life of the overall footwear product 400 has ended. Additionally or alternatively, in at least some examples of this technology: (a) the entire article of footwear 400 may be assembled in an adhesive-free manner; (b) the individual the upper component 102, inflatable bladder 200, and/or foot support component 402 may be made without using adhesives and in an adhesive-free manner; and/or (c) other footwear components present (e.g., components 600, 700, etc.), if any, may be releasably engaged with one another and/or with the other footwear 400 components. One or more of these features, when present, may improve the environmental "friendliness" of the article of footwear 400 and/or may enhance recyclability of the individual component parts (e.g., the upper component 102, the inflatable bladder 200, and/or the foot support component 402). Alternatively, some advantageous features of this technology still may be realized with the upper component 102, the inflatable bladder 200, and/or the foot support component 402 formed from multiple parts and/or constructed using adhesives and/or other permanent connections. While such modifications may adversely affect the ability to recycle some components and/or the overall structure, a useful article of footwear product still may be produced. Thus, not all aspects of this technology need have improved recyclability and/or improved environmentally friendly features described herein for some aspects of this technology.

In the specific examples described above, an overall footwear 400 structure, including an upper component 102 and foot support components (inflatable bladder 200 and foot support component 402), are releasably held together using one or more expandable lugs 210 of the impact force-attenuating component 200 extending into one or more receptacles 410 of the foot support component 402. In some examples of this technology, however, the upper component 102 need not be included in the structures held together using one or more expandable lugs 210 extending into one or more receptacles 410. Rather, an impact force-attenuating component 200 and a foot support component 402 may be held together, assembled, and disassembled in any of the various manners described above without an upper component extending between the impact force-attenuating component 200 and the foot support component 402. In such structures, an upper component (e.g., including one or more component parts and/or of conventional construction) may be engaged with the impact force-attenuating component 200 and/or the foot support component 402 before or after the impact force-attenuating component 200 and the foot support component 402 are releasably engaged together by one or more expandable lugs 210 extending into one or more receptacles 410. The upper component(s) may be engaged with either or both of the impact force-attenuating component 200 and the foot support component 402, e.g., by one or more of adhesives, mechanical connectors, sewn seams, etc.

The above description also focuses on structures in which an inflatable bladder 200 includes a single fluid chamber 204 that extends into and is in fluid communication with all of the inflatable lugs 210. Other arrangements and structures are possible. For example, a footwear structure 400 may include multiple, separate inflatable bladders 200 with separate fluid chambers 204 provided in the separate bladders (and each bladder including one or more expandable lugs 210). As another example, the interior of a single inflatable bladder may include separated compartments that are in fluid isolation from one another (e.g., such that not all inflatable lugs 210 are in open fluid communication with one another). Use of such separated and fluid isolated inflatable lugs 210 may help hold an article of footwear 400 together in the event that one or more inflatable lugs deflate for any reason.

The above specific examples also focus on structures in which the expandable securing element(s) is (are) an inflatable lug 210 inflated by a gas. Other structures are possible. For example, rather than inflating with gas, a bladder 200 could be filled with a liquid, and thus, the expandable lugs 210 in that structure would be expanded due to introduced liquid. Once the interior chamber 204 of the bladder 200 is filled with the liquid, the chamber 204 can be sealed, and the bladder 200 may operate in the manner described above.

As other potential features, the bladder 200 and/or the expandable lug(s) 210 may constitute a portion of an impact force-attenuating component that includes other component parts as well. For example, a bladder 200 of the various types described above may be at least partially contained within a polymeric foam midsole component and/or a midsole component including one or more mechanical impact force-attenuating components.

III. CONCLUSION

The present technology is disclosed above and in the accompanying drawings with reference to a variety of embodiments. The purpose served by the disclosure, however, is to provide an example of the various features and concepts related to the technology, not to limit its scope. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. An article of footwear, comprising:

an upper component having a first through hole opening;

a foot support component having a first surface, wherein the foot support component is shaped to form a first receptacle having a first interior chamber, and wherein a first opening defined at the first surface provides access to the first interior chamber; and an inflatable bladder including: (i) a first sheet for supporting at least a portion of a plantar surface of a wearer's foot, (ii) a second sheet opposite the first sheet, and (iii) a first inflatable lug extending from the second sheet, wherein a sealed fluid chamber is defined between the first sheet and the second sheet, wherein the sealed fluid chamber extends within the first inflatable lug, wherein the first inflatable lug extends through the first through hole opening and into the first receptacle, and wherein, when inflated with a gas, the first inflatable lug has a size and/or shape and/or rigidity that inhibits the first inflatable lug from pulling out of the first interior chamber through the first opening.

Clause 2. The article of footwear according to clause 1, wherein: (i) the upper component includes a second through hole opening, (ii) the foot support component includes a second receptacle having a second interior chamber, wherein a second opening defined at the first surface provides access to the second interior chamber, and (iii) the inflatable bladder includes a second inflatable lug extending from the second sheet, wherein the sealed fluid chamber extends within the second inflatable lug, wherein the second inflatable lug extends through the second through hole opening and into the second receptacle, and wherein, when inflated with the gas, the second inflatable lug has a size and/or shape and/or rigidity that inhibits the second inflatable lug from pulling out of the second interior chamber through the second opening.

Clause 3. The article of footwear according to clause 2, wherein: (i) the upper component includes a third through hole opening, (ii) the foot support component includes a third receptacle having a third interior chamber, wherein a third opening defined at the first surface provides access to the third interior chamber, and (iii) the inflatable bladder includes a third inflatable lug extending from the second sheet, wherein the sealed fluid chamber extends within the third inflatable lug, wherein the third inflatable lug extends through the third through hole opening and into the third receptacle, and wherein, when inflated with the gas, the third inflatable lug has a size and/or shape and/or rigidity that inhibits the third inflatable lug from pulling out of the third interior chamber through the third opening.

Clause 4. The article of footwear according to clause 3, wherein the foot support component includes a ground-facing surface located opposite the first surface, wherein the ground-facing surface includes: (i) a first ground-facing lug that at least partially encloses the first interior chamber, (ii) a second ground-facing lug that at least partially encloses the second interior chamber and is spaced from the first ground-facing lug, and (iii) a third ground-facing lug that at least partially encloses the third interior chamber and is spaced from the first ground-facing lug and from the second ground-facing lug.

Clause 5. The article of footwear according to clause 4, further comprising: a first ground-engaging component engaged with the first ground-facing lug, a second ground-engaging component engaged with the second ground-facing lug, and a third ground-engaging component engaged with the third ground-facing lug.

Clause 6. The article of footwear according to clause 3, wherein the foot support component includes a ground-facing surface located opposite the first surface, wherein the ground-facing surface includes a first ground-facing lug that at least partially encloses the first interior chamber, the second interior chamber, and the third interior chamber.

Clause 7. The article of footwear according to clause 6, further comprising: a first ground-engaging component engaged with the first ground-facing lug.

Clause 8. The article of footwear according to clause 3, wherein the foot support component includes a ground-facing surface located opposite the first surface, wherein the ground-facing surface includes a continuous ground-facing element that at least partially encloses the first interior chamber, the second interior chamber, and the third interior chamber.

Clause 9. The article of footwear according to clause 8, further comprising: a first ground-engaging component engaged with the continuous ground-facing element.

Clause 10. The article of footwear according to clause 2 or 3, wherein the foot support component includes a ground-facing surface located opposite the first surface, wherein the ground-facing surface includes: (i) a first ground-facing lug that at least partially encloses the first interior chamber, and (ii) a second ground-facing lug that at least partially encloses the second interior chamber and is spaced from the first ground-facing lug.

Clause 11. The article of footwear according to clause 10, further comprising: a first ground-engaging component engaged with the first ground-facing lug and a second ground-engaging component engaged with the second ground-facing lug.

Clause 12. The article of footwear according to clause 2 or 3, wherein the foot support component includes a ground-facing surface located opposite the first surface, wherein the ground-facing surface includes a first ground-facing lug that at least partially encloses the first interior chamber and the second interior chamber.

Clause 13. The article of footwear according to clause 12, further comprising: a first ground-engaging component engaged with the first ground-facing lug.

Clause 14. The article of footwear according to clause 2 or 3, wherein the foot support component includes a ground-facing surface located opposite the first surface, wherein the ground-facing surface includes a continuous ground-facing element that at least partially encloses the first interior chamber and the second interior chamber.

Clause 15. The article of footwear according to clause 14, further comprising: a first ground-engaging component engaged with the continuous ground-facing element.

Clause 16. The article of footwear according to any one of clauses 1 to 3, wherein the foot support component includes a ground-facing surface located opposite the first surface, wherein the ground-facing surface includes a first ground-facing element that at least partially encloses the first interior chamber.

Clause 17. The article of footwear according to clause 16, further comprising: a first ground-engaging component engaged with the first ground-facing element.

Clause 18. The article of footwear according to any one of clauses 1 to 17, wherein the upper component, the foot support component, and the inflatable bladder are engaged together in an adhesive-free manner.

Clause 19. The article of footwear according to any one of clauses 1 to 18, wherein the upper component includes a first surface and a second surface located opposite the first surface, wherein the first surface of the upper component lies immediately adjacent the first surface of the foot support component, and wherein the second surface of the upper component lies immediately adjacent the second sheet of the inflatable bladder.

Clause 20. An article of footwear, comprising:

an upper component having a plurality of through hole openings;

a foot support component having a first surface, wherein the foot support component is shaped to form a plurality of receptacles, each receptacle having an interior chamber, and wherein a plurality of openings corresponding to the plurality of receptacles are defined at the first surface, the openings of the plurality of openings providing access to a corresponding interior chamber; and an inflatable bladder including: (i) a first sheet for supporting at least a portion of a plantar surface of a wearer's foot, (ii) a second sheet opposite the first sheet, and (iii) a plurality of inflatable lugs extending from the second sheet, wherein a sealed fluid chamber is defined between the first sheet and the second sheet, wherein the sealed fluid chamber extends within the plurality of inflatable lugs, wherein the plurality of inflatable lugs extend through corresponding through hole openings of the upper component and into corresponding receptacles of the foot support component, and wherein, when inflated with a gas, the plurality of inflatable lugs have a size and/or shape and/or rigidity that inhibit the inflatable lugs from pulling out of the corresponding interior chamber through the corresponding opening of the plurality of openings.

Clause 21. The article of footwear according to clause 20, wherein the foot support component includes a ground-facing surface located opposite the first surface, wherein the ground-facing surface includes one or more ground-facing elements that at least partially enclose one or more interior chambers formed in one or more of the plurality of receptacles.

Clause 22. The article of footwear according to clause 21, further comprising: one or more ground-engaging components engaged with at least one of the one or more ground-facing elements.

Clause 23. The article of footwear according to any one of clauses 20 to 22, wherein the upper component, the foot support component, and the inflatable bladder are engaged together in an adhesive-free manner.

Clause 24. The article of footwear according to any one of clauses 20 to 23, wherein the plurality of through hole openings and the plurality of inflatable lugs are arranged in a plurality of rows extending in a medial side-to-lateral side direction of the article of footwear and/or in a plurality of columns extending in an anterior-to-posterior direction of the article of footwear.

Clause 25. The article of footwear according to any one of clauses 20 to 24, wherein the upper component includes a first surface and a second surface located opposite the first surface, wherein the first surface of the upper component lies immediately adjacent the first surface of the foot support component, and wherein the second surface of the upper component lies immediately adjacent the second sheet of the inflatable bladder.

Clause 26. A method of assembling an article of footwear, comprising:

providing an upper component having a first through hole opening;

providing a foot support component having a first surface, wherein the foot support component is shaped to form a first receptacle having a first interior chamber, and wherein a first opening defined at the first surface provides access to the first interior chamber;

providing an inflatable bladder having: (i) a first sheet for supporting at least a portion of a plantar surface of a wearer's foot, (ii) a second sheet opposite the first sheet, and (iii) a first inflatable lug extending from the second sheet, wherein a fluid chamber is defined between the first sheet and the second sheet and within the first inflatable lug;

with the fluid chamber in a first pressure condition, positioning the second sheet of the inflatable bladder with respect to the upper component such that the first inflatable lug extends through the first through hole opening and into the first receptacle; and with the first inflatable lug extending into the first receptacle, introducing gas into the fluid chamber to change the fluid chamber to a second pressure condition, wherein the second pressure condition is at a higher pressure than the first pressure condition, and wherein the step of introducing the gas into the fluid chamber changes a size and/or shape and/or rigidity of the first inflatable lug such that the first inflatable lug is inhibited from pulling out of the first interior chamber through the first opening.

Clause 27. The method according to clause 26, wherein: (i) the upper component includes a second through hole opening, (ii) the foot support component includes a second receptacle having a second interior chamber, wherein a second opening defined at the first surface provides access to the second interior chamber, and (iii) the inflatable bladder includes a second inflatable lug extending from the second sheet, wherein the fluid chamber extends within the second inflatable lug, wherein the positioning step includes positioning the second sheet of the inflatable bladder with respect to the upper component such that the second inflatable lug extends through the second through hole opening and into the second receptacle, and wherein the introducing step includes introducing gas into the fluid chamber to change a size and/or shape and/or rigidity of the second inflatable lug such that the second inflatable lug is inhibited from pulling out of the second interior chamber through the second opening.

Clause 28. The method according to clause 27, wherein: (i) the upper component includes a third through hole opening, (ii) the foot support component includes a third receptacle having a third interior chamber, wherein a third opening defined at the first surface provides access to the third interior chamber, and (iii) the inflatable bladder includes a third inflatable lug extending from the second sheet, wherein the fluid chamber extends within the third inflatable lug, wherein the positioning step includes positioning the second sheet of the inflatable bladder with respect to the upper component such that the third inflatable lug extends through the third through hole opening and into the third receptacle, and wherein the introducing step includes introducing gas into the fluid chamber to change a size and/or shape and/or rigidity of the third inflatable lug such that the third inflatable lug is inhibited from pulling out of the third interior chamber through the third opening.

Clause 29. The method according to clause 28, wherein the foot support component includes a ground-facing surface located opposite the first surface, wherein the ground-facing surface includes: (i) a first ground-facing lug that at least partially encloses the first interior chamber, (ii) a second ground-facing lug that at least partially encloses the second interior chamber and is spaced from the first ground-facing lug, and (iii) a third ground-facing lug that at least partially encloses the third interior chamber and is spaced from the first ground-facing lug and from the second ground-facing lug.

Clause 30. The method according to clause 29, further comprising: engaging a first ground-engaging component with the first ground-facing lug, engaging a second ground-engaging component with the second ground-facing lug, and engaging a third ground-engaging component with the third ground-facing lug.

Clause 31. The method according to clause 28, wherein the foot support component includes a ground-facing surface located opposite the first surface, wherein the ground-facing surface includes a first ground-facing lug that at least partially encloses the first interior chamber, the second interior chamber, and the third interior chamber.

Clause 32. The method according to clause 31, further comprising: engaging a first ground-engaging component with the first ground-facing lug.

Clause 33. The method according to clause 28, wherein the foot support component includes a ground-facing surface located opposite the first surface, wherein the ground-facing surface includes a continuous ground-facing element that at least partially encloses the first interior chamber, the second interior chamber, and the third interior chamber.

Clause 34. The method according to clause 33, further comprising: engaging a first ground-engaging component with the continuous ground-facing element.

Clause 35. The method according to clause 27 or 28, wherein the foot support component includes a ground-facing surface located opposite the first surface, wherein the ground-facing surface includes: (i) a first ground-facing lug that at least partially encloses the first interior chamber, and (ii) a second ground-facing lug that at least partially encloses the second interior chamber and is spaced from the first ground-facing lug.

Clause 36. The method according to clause 35, further comprising: engaging a first ground-engaging component with the first ground-facing lug, and engaging a second ground-engaging component with the second ground-facing lug.

Clause 37. The method according to clause 27 or 28, wherein the foot support component includes a ground-facing surface located opposite the first surface, wherein the ground-facing surface includes a first ground-facing lug that at least partially encloses the first interior chamber and the second interior chamber.

Clause 38. The method according to clause 37, further comprising: engaging a first ground-engaging component with the first ground-facing lug.

Clause 39. The method according to clause 27 or 28, wherein the foot support component includes a ground-facing surface located opposite the first surface, wherein the ground-facing surface includes a continuous ground-facing element that at least partially encloses the first interior chamber and the second interior chamber.

Clause 40. The method according to clause 39, further comprising: engaging a first ground-engaging component engaged with the continuous ground-facing element.

Clause 41. The method according to any one of clauses 26 to 28, wherein the foot support component includes a ground-facing surface located opposite the first surface, wherein the ground-facing surface includes a first ground-facing element that at least partially encloses the first interior chamber.

Clause 42. The method according to clause 41, further comprising: engaging a first ground-engaging component with the first ground-facing element.

Clause 43. The method according to any one of clauses 26 to 42, wherein the upper component, the foot support component, and the inflatable bladder are engaged together in an adhesive-free manner.

Clause 44. A method of assembling an article of footwear, comprising:

providing an upper component having a plurality of through hole openings;

providing a foot support component having a first surface, wherein the foot support component is shaped to form a plurality of receptacles, each receptacle having an interior chamber, and wherein a plurality of openings are defined at the first surface providing access to a corresponding interior chamber;

providing an inflatable bladder having: (i) a first sheet for supporting at least a portion of a plantar surface of a wearer's foot, (ii) a second sheet opposite the first sheet, and (iii) a plurality of inflatable lugs extending from the second sheet, wherein a fluid chamber is defined between the first sheet and the second sheet and within the plurality of inflatable lugs;

with the fluid chamber in a first pressure condition, positioning the second sheet of the inflatable bladder with respect to the upper component such that the plurality of inflatable lugs extend through corresponding through hole openings of the upper component and into corresponding receptacles of the plurality of receptacles; and with the plurality of inflatable lugs extending into corresponding receptacles, introducing gas into the fluid chamber to change the fluid chamber to a second pressure condition, wherein the second pressure condition is at a higher pressure than the first pressure condition, and wherein the step of introducing the gas into the fluid chamber changes a size and/or shape and/or rigidity of the plurality of inflatable lugs such that the plurality of inflatable lugs are inhibited from pulling out of their corresponding receptacles.

Clause 45. The method according to clause 44, wherein the foot support component includes a ground-facing surface located opposite the first surface, wherein the ground-facing surface includes one or more ground-facing elements that at least partially enclose one or more interior chambers formed in one or more of the plurality of receptacles.

Clause 46. The method according to clause 45, further comprising: engaging one or more ground-engaging components with at least one of the one or more ground-facing elements.

Clause 47. The method according to any one of clauses 44 to 46, wherein the upper component, the foot support component, and the inflatable bladder are engaged together in an adhesive-free manner.

Clause 48. The method according to any one of clauses 44 to 47, wherein the plurality of through hole openings and the plurality of inflatable lugs are arranged in a plurality of rows extending in a medial side-to-lateral side direction of the article of footwear and/or in a plurality of columns extending in an anterior-to-posterior direction of the article of footwear.

Clause 49. An article of footwear, comprising:

an upper component having a first through hole opening;

a foot support component having a first surface, wherein the foot support component is shaped to form a first receptacle having a first interior chamber, and wherein a first opening defined at the first surface provides access to the first interior chamber; and an impact force-attenuating component including: (i) a foot support surface for supporting at least a portion of a plantar surface of a wearer's foot, (ii) a base surface opposite the foot support surface, and (iii) a first expandable lug extending from the base surface, wherein a sealed fluid chamber is defined at least within the first expandable lug, wherein the first expandable lug extends through the first through hole opening and into the first receptacle, and wherein, when the sealed fluid chamber is filled with a fluid, the first expandable lug has a size and/or shape and/or rigidity that inhibits the first expandable lug from pulling out of the first interior chamber through the first opening.

Clause 50. The article of footwear according to clause 49, wherein: (i) the upper component includes a second through hole opening, (ii) the foot support component includes a second receptacle having a second interior chamber, wherein a second opening defined at the first surface provides access to the second interior chamber, and (iii) the impact force-attenuating component includes a second expandable lug extending from the base surface, wherein the sealed fluid chamber extends within the second expandable lug, wherein the second expandable lug extends through the second through hole opening and into the second receptacle, and wherein, when filled with the fluid, the second expandable lug has a size and/or shape and/or rigidity that inhibits the second expandable lug from pulling out of the second interior chamber through the second opening.

Clause 51. The article of footwear according to clause 50, wherein: (i) the upper component includes a third through hole opening, (ii) the foot support component includes a third receptacle having a third interior chamber, wherein a third opening defined at the first surface provides access to the third interior chamber, and (iii) the impact force-attenuating element includes a third expandable lug extending from the base surface, wherein the sealed fluid chamber extends within the third expandable lug, wherein the third expandable lug extends through the third through hole opening and into the third receptacle, and wherein, when filled with the fluid, the third expandable lug has a size and/or shape and/or rigidity that inhibits the third expandable lug from pulling out of the third interior chamber through the third opening.

Clause 52. The article of footwear according to clause 51, wherein the foot support component includes a ground-facing surface located opposite the first surface, wherein the ground-facing surface includes: (i) a first ground-facing lug that at least partially encloses the first interior chamber, (ii) a second ground-facing lug that at least partially encloses the second interior chamber and is spaced from the first ground-facing lug, and (iii) a third ground-facing lug that at least partially encloses the third interior chamber and is spaced from the first ground-facing lug and from the second ground-facing lug.

Clause 53. The article of footwear according to clause 52, further comprising: a first ground-engaging component engaged with the first ground-facing lug, a second ground-engaging component engaged with the second ground-facing lug, and a third ground-engaging component engaged with the third ground-facing lug.

Clause 54. The article of footwear according to clause 51, wherein the foot support component includes a ground-facing surface located opposite the first surface, wherein the ground-facing surface includes a first ground-facing lug that at least partially encloses the first interior chamber, the second interior chamber, and the third interior chamber.

Clause 55. The article of footwear according to clause 54, further comprising: a first ground-engaging component engaged with the first ground-facing lug.

Clause 56. The article of footwear according to clause 51, wherein the foot support component includes a ground-facing surface located opposite the first surface, wherein the ground-facing surface includes a continuous ground-facing element that at least partially encloses the first interior chamber, the second interior chamber, and the third interior chamber.

Clause 57. The article of footwear according to clause 56, further comprising: a first ground-engaging component engaged with the continuous ground-facing element.

Clause 58. The article of footwear according to clause 50 or 51, wherein the foot support component includes a ground-facing surface located opposite the first surface, wherein the ground-facing surface includes: (i) a first ground-facing lug that at least partially encloses the first interior chamber, and (ii) a second ground-facing lug that at least partially encloses the second interior chamber and is spaced from the first ground-facing lug.

Clause 59. The article of footwear according to clause 58, further comprising: a first ground-engaging component engaged with the first ground-facing lug and a second ground-engaging component engaged with the second ground-facing lug.

Clause 60. The article of footwear according to clause 50 or 51, wherein the foot support component includes a ground-facing surface located opposite the first surface, wherein the ground-facing surface includes a first ground-facing lug that at least partially encloses the first interior chamber and the second interior chamber.

Clause 61. The article of footwear according to clause 60, further comprising: a first ground-engaging component engaged with the first ground-facing lug.

Clause 62. The article of footwear according to clause 50 or 51, wherein the foot support component includes a ground-facing surface located opposite the first surface, wherein the ground-facing surface includes a continuous ground-facing element that at least partially encloses the first interior chamber and the second interior chamber.

Clause 63. The article of footwear according to clause 62, further comprising: a first ground-engaging component engaged with the continuous ground-facing element.

Clause 64. The article of footwear according to any one of clauses 49 to 51, wherein the foot support component includes a ground-facing surface located opposite the first surface, wherein the ground-facing surface includes a first ground-facing element that at least partially encloses the first interior chamber.

Clause 65. The article of footwear according to clause 64, further comprising: a first ground-engaging component engaged with the first ground-facing element.

Clause 66. The article of footwear according to any one of clauses 49 to 65, wherein the upper component, the foot support component, and the impact force-attenuating component are engaged together in an adhesive-free manner.

Clause 67. The article of footwear according to any one of clauses 49 to 66, wherein the upper component includes a first surface and a second surface located opposite the first surface, wherein the first surface of the upper component lies immediately adjacent the first surface of the foot support component, and wherein the second surface of the upper component lies immediately adjacent the base surface of the impact force-attenuating component.

Clause 68. The article of footwear according to any one of clauses 49 to 67, wherein the fluid filling the sealed fluid chamber is a gas.

Clause 69. An article of footwear, comprising:

an upper component having a plurality of through hole openings;

a foot support component having a first surface, wherein the foot support component is shaped to form a plurality of receptacles, each receptacle having an interior chamber, and wherein a plurality of openings corresponding to the plurality of receptacles are defined at the first surface, the openings of the plurality of openings providing access to a corresponding interior chamber; and an impact force-attenuating component including: (i) a foot support surface for supporting at least a portion of a plantar surface of a wearer's foot, (ii) a base surface opposite the foot support surface, and (iii) a plurality of expandable lugs extending from the base surface, wherein the plurality of expandable lugs define one or more sealed fluid chambers within the plurality of expandable lugs, wherein the plurality of expandable lugs extend through corresponding through hole openings of the upper component and into corresponding receptacles of the foot support component, and wherein, when the one or more sealed fluid chambers is filled with a fluid, the plurality of expandable lugs has a size and/or shape and/or rigidity that inhibit the plurality of expandable lugs from pulling out of the corresponding interior chamber through the corresponding opening of the plurality of openings.

Clause 70. The article of footwear according to clause 69, wherein the foot support component includes a ground-facing surface located opposite the first surface, wherein the ground-facing surface includes one or more ground-facing elements that at least partially enclose one or more interior chambers formed in one or more of the plurality of receptacles.

Clause 71. The article of footwear according to clause 70, further comprising: one or more ground-engaging component engaged with at least one of the one or more ground-facing elements.

Clause 72. The article of footwear according to any one of clauses 69 to 71, wherein the upper component, the foot support component, and the impact force-attenuating component are engaged together in an adhesive-free manner.

Clause 73. The article of footwear according to any one of clauses 69 to 72, wherein the plurality of through hole openings and the plurality of expandable lugs are arranged in a plurality of rows extending in a medial side-to-lateral side direction of the article of footwear and/or in a plurality of columns extending in an anterior-to-posterior direction of the article of footwear.

Clause 74. The article of footwear according to any one of clauses 69 to 73, wherein the upper component includes a first surface and a second surface located opposite the first surface, wherein the first surface of the upper component lies immediately adjacent the first surface of the foot support component, and wherein the second surface of the upper component lies immediately adjacent the base surface of the impact force-attenuating component.

Clause 75. The article of footwear according to any one of clauses 69 to 74, wherein the fluid filling the one or more sealed fluid chambers is a gas.

Clause 76. A method of assembling an article of footwear, comprising:

providing an upper component having a first through hole opening;

providing a foot support component having a first surface, wherein the foot support component is shaped to form a first receptacle having a first interior chamber, and wherein a first opening defined at the first surface provides access to the first interior chamber;

providing an impact force-attenuating component having: (i) a foot support surface for supporting at least a portion of a plantar surface of a wearer's foot, (ii) a base surface opposite the foot support surface, and (iii)

a first expandable lug extending from the base surface, wherein a first fluid chamber is defined at least within the first expandable lug;

with the first fluid chamber in a contracted condition, positioning the base surface of the impact force-attenuating component with respect to the upper component such that the first expandable lug extends through the first through hole opening and into the first receptacle; and with the first expandable lug extending into the first receptacle, introducing fluid into the first fluid chamber to change the first fluid chamber from the contracted condition to an expanded condition during which a size and/or shape and/or rigidity of the first expandable lug changes such that the first expandable lug is inhibited from pulling out of the first interior chamber through the first opening.

Clause 77. The method according to clause 76, wherein: (i) the upper component includes a second through hole opening, (ii) the foot support component includes a second receptacle having a second interior chamber, wherein a second opening defined at the first surface provides access to the second interior chamber, and (iii) the impact force-attenuating component includes a second expandable lug extending from the base surface, wherein a second fluid chamber extends within the second inflatable lug, wherein the positioning step includes positioning the base surface of the impact force-attenuating component with respect to the upper component such that the second expandable lug extends through the second through hole opening and into the second receptacle, and wherein the introducing step includes introducing fluid into the second fluid chamber to change a size and/or shape and/or rigidity of the second expandable lug such that the second expandable lug is inhibited from pulling out of the second interior chamber through the second opening.

Clause 78. The method according to clause 77, wherein: (i) the upper component includes a third through hole opening, (ii) the foot support component includes a third receptacle having a third interior chamber, wherein a third opening defined at the first surface provides access to the third interior chamber, and (iii) the impact force-attenuating component includes a third expandable lug extending from the base surface, wherein a third fluid chamber extends within the third expandable lug, wherein the positioning step includes positioning the base surface of the impact force-attenuating component with respect to the upper component such that the third expandable lug extends through the third through hole opening and into the third receptacle, and wherein the introducing step includes introducing fluid into the third fluid chamber to change a size and/or shape and/or rigidity of the third expandable lug such that the third expandable lug is inhibited from pulling out of the third interior chamber through the third opening.

Clause 79. The method according to clause 78, wherein the foot support component includes a ground-facing surface located opposite the first surface, wherein the ground-facing surface includes: (i) a first ground-facing lug that at least partially encloses the first interior chamber, (ii) a second ground-facing lug that at least partially encloses the second interior chamber and is spaced from the first ground-facing lug, and (iii) a third ground-facing lug that at least partially encloses the third interior chamber and is spaced from the first ground-facing lug and from the second ground-facing lug.

Clause 80. The method according to clause 79, further comprising: engaging a first ground-engaging component with the first ground-facing lug, engaging a second ground-engaging component with the second ground-facing lug, and engaging a third ground-engaging component with the third ground-facing lug.

Clause 81. The method of footwear according to clause 78, wherein the foot support component includes a ground-facing surface located opposite the first surface, wherein the ground-facing surface includes a first ground-facing lug that at least partially encloses the first interior chamber, the second interior chamber, and the third interior chamber.

Clause 82. The method according to clause 81, further comprising: engaging a first ground-engaging component with the first ground-facing lug.

Clause 83. The method according to clause 78, wherein the foot support component includes a ground-facing surface located opposite the first surface, wherein the ground-facing surface includes a continuous ground-facing element that at least partially encloses the first interior chamber, the second interior chamber, and the third interior chamber.

Clause 84. The method according to clause 83, further comprising: a first ground-engaging component engaged with the continuous ground-facing element.

Clause 85. The method according to clause 77 or 78, wherein the foot support component includes a ground-facing surface located opposite the first surface, wherein the ground-facing surface includes: (i) a first ground-facing lug that at least partially encloses the first interior chamber, and (ii) a second ground-facing lug that at least partially encloses the second interior chamber and is spaced from the first ground-facing lug.

Clause 86. The method according to clause 85, further comprising: engaging a first ground-engaging component with the first ground-facing lug, and engaging a second ground-engaging component with the second ground-facing lug.

Clause 87. The method according to clause 77 or 78, wherein the foot support component includes a ground-facing surface located opposite the first surface, wherein the ground-facing surface includes a first ground-facing lug that at least partially encloses the first interior chamber and the second interior chamber.

Clause 88. The method according to clause 87, further comprising: engaging a first ground-engaging component with the first ground-facing lug.

Clause 89. The method according to clause 77 or 78, wherein the foot support component includes a ground-facing surface located opposite the first surface, wherein the ground-facing surface includes a continuous ground-facing element that at least partially encloses the first interior chamber and the second interior chamber.

Clause 90. The method according to clause 89, further comprising: a first ground-engaging component engaged with the continuous ground-facing element.

Clause 91. The method according to any one of clauses 76 to 78, wherein the foot support component includes a ground-facing surface located opposite the first surface, wherein the ground-facing surface includes a first ground-facing lug that at least partially encloses the first interior chamber.

Clause 92. The method according to clause 91, further comprising: engaging a first ground-engaging component with the first ground-facing lug.

Clause 93. The method according to any one of clauses 76 to 92, wherein the upper component, the foot support component, and the impact force-attenuating component are engaged together in an adhesive-free manner.

Clause 94. The method according to any one of clauses 76 to 93, wherein the step of introducing the fluid into the first fluid chamber includes inflating the first fluid chamber with a gas.

Clause 95. A method of assembling an article of footwear, comprising:

providing an upper component having a plurality of through hole openings;

providing a foot support component having a first surface, wherein the foot support component is shaped to form a plurality of receptacles, each receptacle having an interior chamber, and wherein a plurality of openings are defined at the first surface providing access to a corresponding interior chamber;

providing an impact force-attenuating component having: (i) a foot support surface for supporting at least a portion of a plantar surface of a wearer's foot, (ii) a base surface opposite the foot support surface, and (iii) a plurality of expandable lugs extending from the base surface, wherein the plurality of expandable lugs define a corresponding plurality of fluid chambers;

with the plurality of fluid chambers in contracted conditions, positioning the base surface of the impact force-attenuating component with respect to the upper component such that the plurality of expandable lugs extend through corresponding through hole openings of the upper component and into corresponding receptacles of the plurality of receptacles; and with the plurality of expandable lugs extending into corresponding receptacles, introducing fluid into the plurality of fluid chambers to change the plurality of fluid chambers to expanded conditions, wherein when changing from the contracted conditions to the expanded conditions, sizes and/or shapes and/or rigidities of the plurality of expandable lug change such that the plurality of expandable lugs are inhibited from pulling out of their corresponding receptacles.

Clause 96. The method according to clause 95, wherein the foot support component includes a ground-facing surface located opposite the first surface, wherein the ground-facing surface includes one or more ground-facing lugs that at least partially enclose one or more interior chambers formed in one or more of the plurality of receptacles.

Clause 97. The method according to clause 96, further comprising: engaging one or more ground-engaging components with at least one of the one or more ground-facing lugs.

Clause 98. The method according to any one of clauses 95 to 97, wherein the upper component, the foot support component, and the impact force-attenuating component are engaged together in an adhesive-free manner.

Clause 99. The method according to any one of clauses 95 to 98, wherein the plurality of through hole openings and the plurality of expandable lugs are arranged in a plurality of rows extending in a medial side-to-lateral side direction of the article of footwear and/or in a plurality of columns extending in an anterior-to-posterior direction of the article of footwear.

Clause 100. The method according to any one of clauses 95 to 99, wherein the step of introducing the fluid into the plurality of fluid chambers includes inflating the plurality of fluid chambers with a gas.

Clause 101. A method of disassembling a sole structure and/or an article of footwear comprising:

deflating at least a first inflatable lug of an inflatable bladder, wherein the first inflatable lug includes: (i) a base portion that extends to a first receptacle formed in a foot support component and (ii) an inflatable securing portion that, when inflated with a gas, has a size and/or shape and/or rigidity that inhibits the first inflatable lug from pulling out of the first receptacle; and after sufficient deflating, removing the inflatable securing portion of the first inflatable lug from the first receptacle.

Clause 102. The method of clause 101, wherein the base portion of the first inflatable lug extends through a first through hole opening of an upper component.

Clause 103. The method of clause 101 or 102, wherein the article of footwear has a structure according to any one of clauses 1 to 19.

Clause 104. A method of disassembling a sole structure and/or an article of footwear comprising:

deflating at least a plurality of inflatable lugs of an inflatable bladder, wherein each of the plurality of inflatable lugs includes: (i) a base portion that extends to one of a plurality of receptacles formed in a foot support component and (ii) an inflatable securing portion that, when inflated with a gas, has a size and/or shape and/or rigidity that inhibits the plurality of inflatable lugs from pulling out of a corresponding receptacle of the plurality of receptacles; and after sufficient deflating, removing the inflatable securing portions of the plurality of inflatable lugs from the plurality of receptacles.

Clause 105. The method of clause 104, wherein the base portions of the plurality of inflatable lugs extend through a corresponding plurality of through hole openings of an upper component.

Clause 106. The method of clause 104 or 105, wherein the article of footwear has a structure according to any one of clauses 20 to 25.

Clause 107. A method of disassembling a sole structure and/or an article of footwear comprising:

releasing fluid from at least a first expandable lug of an impact force-attenuating component, wherein the first expandable lug includes: (i) a base portion that extends to a first receptacle formed in a foot support component and (ii) an expandable securing portion that, when filled with a fluid, has a size and/or shape and/or rigidity that inhibits the first expandable lug from pulling out of the first receptacle; and after releasing sufficient fluid, removing the expandable securing portion from the first expandable lug out of the first receptacle.

Clause 108. The method of clause 107, wherein the base portion of the first expandable lug extends through a first through hole opening of an upper component.

Clause 109. The method of clause 107 or 108, wherein the article of footwear has a structure according to any one of clauses 49 to 68.

Clause 110. A method of disassembling a sole structure and/or an article of footwear comprising:

releasing fluid from at least a plurality of expandable lugs of an impact force-attenuating component, wherein each of the plurality of expandable lugs includes: (i) a base portion that extends to one of a plurality of receptacles formed in a foot support component and (ii) an expandable securing portion that, when filled with a fluid, has a size and/or shape and/or rigidity that inhibits the plurality of expandable lugs from pulling out of a corresponding receptacle of the plurality of receptacles; and after releasing sufficient fluid, removing the expandable securing portions of the plurality of expandable lugs from the plurality of receptacles.

Clause 111. The method of clause 110, wherein the base portions of the plurality of expandable lugs extend through a corresponding plurality of through hole openings of an upper component.

Clause 112. The method of clause 110 or 111, wherein the article of footwear has a structure according to any one of clauses 69 to 75.

Clause 113. A sole structure and/or an article of footwear, comprising:

a foot support component having a first surface, wherein the foot support component is shaped to form a first receptacle having a first interior chamber, and wherein a first opening defined at the first surface provides access to the first interior chamber; and an inflatable bladder including: (i) a first sheet for supporting at least a portion of a plantar surface of a wearer's foot, (ii) a second sheet opposite the first sheet, and (iii) a first inflatable lug extending from the second sheet, wherein a sealed fluid chamber is defined between the first sheet and the second sheet, wherein the sealed fluid chamber extends within the first inflatable lug, wherein the first inflatable lug extends into the first receptacle, and wherein, when inflated with a gas, the first inflatable lug has a size and/or shape and/or rigidity that inhibits the first inflatable lug from pulling out of the first interior chamber through the first opening.

Clause 114. The sole structure and/or article of footwear according to clause 113, wherein: (i) the foot support component includes a second receptacle having a second interior chamber, wherein a second opening defined at the first surface provides access to the second interior chamber, and (ii) the inflatable bladder includes a second inflatable lug extending from the second sheet, wherein the sealed fluid chamber extends within the second inflatable lug, wherein the second inflatable lug extends into the second receptacle, and wherein, when inflated with the gas, the second inflatable lug has a size and/or shape and/or rigidity that inhibits the second inflatable lug from pulling out of the second interior chamber through the second opening.

Clause 115. The sole structure and/or article of footwear according to clause 114, wherein: (i) the foot support component includes a third receptacle having a third interior chamber, wherein a third opening defined at the first surface provides access to the third interior chamber, and (ii) the inflatable bladder includes a third inflatable lug extending from the second sheet, wherein the sealed fluid chamber extends within the third inflatable lug, wherein the third inflatable lug extends into the third receptacle, and wherein, when inflated with the gas, the third inflatable lug has a size and/or shape and/or rigidity that inhibits the third inflatable lug from pulling out of the third interior chamber through the third opening.

Clause 116. The sole structure and/or article of footwear according to any one of clauses 113 to 115, wherein the foot support component and the inflatable bladder are engaged together in an adhesive-free manner.

Clause 117. The sole structure and/or article of footwear according to any one of clauses 113 to 116, further comprising an upper component having a first portion sandwiched between the first surface of the foot support component and the second sheet of the inflatable bladder.

Clause 118. A sole structure and/or an article of footwear, comprising:

a foot support component having a first surface, wherein the foot support component is shaped to form a plurality of receptacles, each receptacle having an interior chamber, and wherein a plurality of openings corresponding to the plurality of receptacles are defined at the first surface, the openings of the plurality of openings providing access to a corresponding interior chamber; and an inflatable bladder including: (i) a first sheet for supporting at least a portion of a plantar surface of a wearer's foot, (ii) a second sheet opposite the first sheet, and (iii) a plurality of inflatable lugs extending from the second sheet, wherein a sealed fluid chamber is defined between the first sheet and the second sheet, wherein the sealed fluid chamber extends within the plurality of inflatable lugs, wherein the plurality of inflatable lugs extend into corresponding receptacles of the foot support component, and wherein, when inflated with a gas, the plurality of inflatable lugs have a size and/or shape and/or rigidity that inhibit the inflatable lugs from pulling out of the corresponding interior chamber through the corresponding opening of the plurality of openings.

Clause 119. The sole structure and/or article of footwear according to clause 118, wherein the foot support component and the inflatable bladder are engaged together in an adhesive-free manner.

Clause 120. The sole structure and/or article of footwear according to clause 118 or 119, further comprising an upper component having a first portion sandwiched between the first surface of the foot support component and the second sheet of the inflatable bladder.

Clause 121. A method of assembling a sole structure and/or an article of footwear, comprising:

providing a foot support component having a first surface, wherein the foot support component is shaped to form a first receptacle having a first interior chamber, and wherein a first opening defined at the first surface provides access to the first interior chamber;

providing an inflatable bladder having: (i) a first sheet for supporting at least a portion of a plantar surface of a wearer's foot, (ii) a second sheet opposite the first sheet, and (iii) a first inflatable lug extending from the second sheet, wherein a fluid chamber is defined between the first sheet and the second sheet and within the first inflatable lug;

with the fluid chamber in a first pressure condition, positioning the second sheet of the inflatable bladder such that the first inflatable lug extends into the first receptacle; and with the first inflatable lug extending into the first receptacle, introducing gas into the fluid chamber to change the fluid chamber to a second pressure condition, wherein the second pressure condition is at a higher pressure than the first pressure condition, and wherein the step of introducing the gas into the fluid chamber changes a size and/or shape and/or rigidity of the first inflatable lug such that the first inflatable lug is inhibited from pulling out of the first interior chamber through the first opening.

Clause 122. The method according to clause 121, wherein: (i) the foot support component includes a second receptacle having a second interior chamber, wherein a second opening defined at the first surface provides access to the second interior chamber, and (ii) the inflatable bladder includes a second inflatable lug extending from the second sheet, wherein the fluid chamber extends within the second inflatable lug, wherein the positioning step includes positioning the second sheet of the inflatable bladder such that the second inflatable lug extends into the second receptacle, and wherein the introducing step includes introducing gas into the fluid chamber to change a size and/or shape and/or rigidity of the second inflatable lug such that the second inflatable lug is inhibited from pulling out of the second interior chamber through the second opening.

Clause 123. The method according to clause 122, wherein: (i) the foot support component includes a third receptacle having a third interior chamber, wherein a third opening defined at the first surface provides access to the third interior chamber, and (ii) the inflatable bladder includes a third inflatable lug extending from the second sheet, wherein the fluid chamber extends within the third inflatable lug, wherein the positioning step includes positioning the second sheet of the inflatable bladder such that the third inflatable lug extends into the third receptacle, and wherein the introducing step includes introducing gas into the fluid chamber to change a size and/or shape and/or rigidity of the third inflatable lug such that the third inflatable lug is inhibited from pulling out of the third interior chamber through the third opening.

Clause 124. The method according to any one of clauses 121 to 123, wherein the foot support component and the inflatable bladder are engaged together in an adhesive-free manner.

Clause 125. A method of assembling a sole structure and/or an article of footwear, comprising:

providing a foot support component having a first surface, wherein the foot support component is shaped to form a plurality of receptacles, each receptacle having an interior chamber, and wherein a plurality of openings are defined at the first surface providing access to a corresponding interior chamber;

providing an inflatable bladder having: (i) a first sheet for supporting at least a portion of a plantar surface of a wearer's foot, (ii) a second sheet opposite the first sheet, and (iii) a plurality of inflatable lugs extending from the second sheet, wherein a fluid chamber is defined between the first sheet and the second sheet and within the plurality of inflatable lugs;

with the fluid chamber in a first pressure condition, positioning the second sheet of the inflatable bladder such that the plurality of inflatable lugs extend into corresponding receptacles of the plurality of receptacles; and with the plurality of inflatable lugs extending into corresponding receptacles, introducing gas into the fluid chamber to change the fluid chamber to a second pressure condition, wherein the second pressure condition is at a higher pressure than the first pressure condition, and wherein the step of introducing the gas into the fluid chamber changes a size and/or shape and/or rigidity of the plurality of inflatable lugs such that the plurality of inflatable lugs are inhibited from pulling out of their corresponding receptacles.

Clause 126. The method according to clause 125, wherein the foot support component and the inflatable bladder are engaged together in an adhesive-free manner.

Clause 127. A sole structure and/or an article of footwear, comprising:

a foot support component having a first surface, wherein the foot support component is shaped to form a first receptacle having a first interior chamber, and wherein a first opening defined at the first surface provides access to the first interior chamber; and an impact force-attenuating component including: (i) a foot support surface for supporting at least a portion of a plantar surface of a wearer's foot, (ii) a base surface opposite the foot support surface, and (iii) a first expandable lug extending from the base surface, wherein a sealed fluid chamber is defined at least within the first expandable lug, wherein the first expandable lug extends into the first receptacle, and wherein, when the sealed fluid chamber is filled with a fluid, the first expandable lug has a size and/or shape and/or rigidity that inhibits the first expandable lug from pulling out of the first interior chamber through the first opening.

Clause 128. The sole structure and/or article of footwear according to clause 127, wherein: (i) the foot support component includes a second receptacle having a second interior chamber, wherein a second opening defined at the first surface provides access to the second interior chamber, and (ii) the impact force-attenuating component includes a second expandable lug extending from the base surface, wherein the sealed fluid chamber extends within the second expandable lug, wherein the second expandable lug extends into the second receptacle, and wherein, when filled with the fluid, the second expandable lug has a size and/or shape and/or rigidity that inhibits the second expandable lug from pulling out of the second interior chamber through the second opening.

Clause 129. The sole structure and/or article of footwear according to clause 128, wherein: (i) the foot support component includes a third receptacle having a third interior chamber, wherein a third opening defined at the first surface provides access to the third interior chamber, and (ii) the impact force-attenuating element includes a third expandable lug extending from the base surface, wherein the sealed fluid chamber extends within the third expandable lug, wherein the third expandable lug extends into the third receptacle, and wherein, when filled with the fluid, the third expandable lug has a size and/or shape and/or rigidity that inhibits the third expandable lug from pulling out of the third interior chamber through the third opening.

Clause 130. The sole structure and/or article of footwear according to any one of clauses 127 to 129, wherein the foot support component and the impact force-attenuating component bladder are engaged together in an adhesive-free manner.

Clause 131. The sole structure and/or article of footwear according to any one of clauses 127 to 130, further comprising an upper component having a first portion sandwiched between the first surface of the foot support component and the base surface of the impact force-attenuating component.

Clause 132. The sole structure and/or article of footwear according to any one of clauses 127 to 131, wherein the fluid filling the sealed fluid chamber is a gas.

Clause 133. A sole structure and/or an article of footwear, comprising:

a foot support component having a first surface, wherein the foot support component is shaped to form a plurality of receptacles, each receptacle having an interior chamber, and wherein a plurality of openings corresponding to the plurality of receptacles are defined at the first surface, the openings of the plurality of openings providing access to a corresponding interior chamber; and an impact force-attenuating component including: (i) a foot support surface for supporting at least a portion of a plantar surface of a wearer's foot, (ii) a base surface opposite the foot support surface, and (iii) a plurality of expandable lugs extending from the base surface, wherein the plurality of expandable lugs define one or more sealed fluid chambers within the plurality of expandable lugs, wherein the plurality of expandable lugs extend into corresponding receptacles of the foot support component, and wherein, when the one or more sealed fluid chambers is filled with a fluid, the plurality of expandable lugs has a size and/or shape and/or rigidity that inhibit the plurality of expandable lugs from pulling out of the corresponding interior chamber through the corresponding opening of the plurality of openings.

Clause 134. The sole structure and/or article of footwear according to clause 133, wherein the foot support component and the impact force-attenuating component are engaged together in an adhesive-free manner.

Clause 135. The sole structure and/or article of footwear according to clause 133 or 134, further comprising an upper component having a first portion sandwiched between the first surface of the foot support component and the base surface of the impact force-attenuating component.

Clause 136. The sole structure and/or article of footwear according to any one of clauses 133 to 135, wherein the fluid filling the one or more sealed fluid chambers is a gas.

Clause 137. A method of assembling a sole structure and/or an article of footwear, comprising:

providing a foot support component having a first surface, wherein the foot support component is shaped to form a first receptacle having a first interior chamber, and wherein a first opening defined at the first surface provides access to the first interior chamber;

providing an impact force-attenuating component having: (i) a foot support surface for supporting at least a portion of a plantar surface of a wearer's foot, (ii) a base surface opposite the foot support surface, and (iii) a first expandable lug extending from the base surface, wherein a first fluid chamber is defined at least within the first expandable lug;

with the first fluid chamber in a contracted condition, positioning the base surface of the impact force-attenuating component such that the first expandable lug extends the first receptacle; and with the first expandable lug extending into the first receptacle, introducing fluid into the first fluid chamber to change the first fluid chamber from the contracted condition to an expanded condition during which a size and/or shape and/or rigidity of the first expandable lug changes such that the first expandable lug is inhibited from pulling out of the first interior chamber through the first opening.

Clause 138. The method according to clause 137, wherein: (i) the foot support component includes a second receptacle having a second interior chamber, wherein a second opening defined at the first surface provides access to the second interior chamber, and (ii) the impact force-attenuating component includes a second expandable lug extending from the base surface, wherein a second fluid chamber extends within the second expandable lug, wherein the positioning step includes positioning the base surface of the impact force-attenuating component such that the second expandable lug extends into the second receptacle, and wherein the introducing step includes introducing fluid into the second fluid chamber to change a size and/or shape and/or rigidity of the second expandable lug such that the second expandable lug is inhibited from pulling out of the second interior chamber through the second opening.

Clause 139. The method according to clause 138, wherein: (i) the foot support component includes a third receptacle having a third interior chamber, wherein a third opening defined at the first surface provides access to the third interior chamber, and (iii) the impact force-attenuating component includes a third expandable lug extending from the base surface, wherein a third fluid chamber extends within the third expandable lug, wherein the positioning step includes positioning the base surface of the impact force-attenuating component such that the third expandable lug extends into the third receptacle, and wherein the introducing step includes introducing fluid into the third fluid chamber to change a size and/or shape and/or rigidity of the third expandable lug such that the third expandable lug is inhibited from pulling out of the third interior chamber through the third opening.

Clause 140. The method according to any one of clauses 137 to 139, wherein the foot support component and the impact force-attenuating component are engaged together in an adhesive-free manner.

Clause 141. The method according to any one of clauses 137 to 140, wherein the step of introducing the fluid into the first fluid chamber includes inflating the first fluid chamber with a gas.

Clause 142. A method of assembling a sole structure and/or an article of footwear, comprising:

providing a foot support component having a first surface, wherein the foot support component is shaped to form a plurality of receptacles, each receptacle having an interior chamber, and wherein a plurality of openings are defined at the first surface providing access to a corresponding interior chamber;

providing an impact force-attenuating component having: (i) a foot support surface for supporting at least a portion of a plantar surface of a wearer's foot, (ii) a base surface opposite the foot support surface, and (iii) a plurality of expandable lugs extending from the base surface, wherein the plurality of expandable lugs define a corresponding plurality of fluid chambers;

with the plurality of fluid chambers in contracted conditions, positioning the base surface of the impact force-attenuating component such that the plurality of expandable lugs extend into corresponding receptacles of the plurality of receptacles; and with the plurality of expandable lugs extending into corresponding receptacles, introducing fluid into the plurality of fluid chambers to change the plurality of fluid chambers to expanded conditions, wherein when changing from the contracted conditions to the expanded conditions, sizes and/or shapes and/or rigidities of the plurality of expandable lug change such that the plurality of expandable lugs are inhibited from pulling out of their corresponding receptacles.

Clause 143. The method according to clause 142, wherein the foot support component and the impact force-attenuating component are engaged together in an adhesive-free manner.

Clause 144. The method according to clause 142 or 143, wherein the step of introducing the fluid into the plurality of fluid chambers includes inflating the plurality of fluid chambers with a gas.

What is claimed is:

1. An article of footwear, comprising:

an upper component having a first through hole opening;

a foot support component having a first surface, wherein the foot support component is shaped to form a first receptacle having a first interior chamber, and wherein a first opening defined at the first surface provides access to the first interior chamber; and an inflatable bladder including: (i) a first sheet for supporting at least a portion of a plantar surface of a wearer's foot, (ii) a second sheet opposite the first sheet, and (iii) a first inflatable lug extending from the second sheet, wherein a sealed fluid chamber is defined between the first sheet and the second sheet, wherein the sealed fluid chamber extends within the first inflatable lug, wherein the first inflatable lug extends through the first through hole opening and into the first receptacle, and wherein, when inflated with a gas, the first inflatable lug has a size and/or shape and/or rigidity that inhibits the first inflatable lug from pulling out of the first interior chamber through the first opening.

2. The article of footwear according to claim 1, wherein: (i) the upper component includes a second through hole opening, (ii) the foot support component includes a second receptacle having a second interior chamber, wherein a second opening defined at the first surface provides access to the second interior chamber, and (iii) the inflatable bladder includes a second inflatable lug extending from the second sheet, wherein the sealed fluid chamber extends within the second inflatable lug, wherein the second inflatable lug extends through the second through hole opening and into the second receptacle, and wherein, when inflated with the gas, the second inflatable lug has a size and/or shape and/or rigidity that inhibits the second inflatable lug from pulling out of the second interior chamber through the second opening.

3. The article of footwear according to claim 2, wherein: (i) the upper component includes a third through hole opening, (ii) the foot support component includes a third receptacle having a third interior chamber, wherein a third opening defined at the first surface provides access to the third interior chamber, and (iii) the inflatable bladder includes a third inflatable lug extending from the second sheet, wherein the sealed fluid chamber extends within the third inflatable lug, wherein the third inflatable lug extends through the third through hole opening and into the third receptacle, and wherein, when inflated with the gas, the third inflatable lug has a size and/or shape and/or rigidity that inhibits the third inflatable lug from pulling out of the third interior chamber through the third opening.

4. The article of footwear according to claim 3, wherein the foot support component includes a ground-facing surface located opposite the first surface, wherein the ground-facing surface includes: (i) a first ground-facing lug that at least partially encloses the first interior chamber, (ii) a second ground-facing lug that at least partially encloses the second interior chamber and is spaced from the first ground-facing lug, and (iii) a third ground-facing lug that at least partially encloses the third interior chamber and is spaced from the first ground-facing lug and from the second ground-facing lug.

5. The article of footwear according to claim 4, further comprising: a first ground-engaging component engaged with the first ground-facing lug, a second ground-engaging component engaged with the second ground-facing lug, and a third ground-engaging component engaged with the third ground-facing lug.

6. The article of footwear according to claim 3, wherein the foot support component includes a ground-facing surface located opposite the first surface, wherein the ground-facing surface includes a first ground-facing lug that at least partially encloses the first interior chamber, the second interior chamber, and the third interior chamber.

7. The article of footwear according to claim 6, further comprising: a first ground-engaging component engaged with the first ground-facing lug.

8. The article of footwear according to claim 3, wherein the foot support component includes a ground-facing surface located opposite the first surface, wherein the ground-facing surface includes a continuous ground-facing element that at least partially encloses the first interior chamber, the second interior chamber, and the third interior chamber.

9. The article of footwear according to claim 8, further comprising: a first ground-engaging component engaged with the continuous ground-facing element.

10. The article of footwear according to claim 2, wherein the foot support component includes a ground-facing surface located opposite the first surface, wherein the ground-facing surface includes: (i) a first ground-facing lug that at least partially encloses the first interior chamber, and (ii) a second ground-facing lug that at least partially encloses the second interior chamber and is spaced from the first ground-facing lug.

11. The article of footwear according to claim 10, further comprising: a first ground-engaging component engaged with the first ground-facing lug and a second ground-engaging component engaged with the second ground-facing lug.

12. The article of footwear according to claim 2, wherein the foot support component includes a ground-facing surface located opposite the first surface, wherein the ground-facing surface includes a first ground-facing lug that at least partially encloses the first interior chamber and the second interior chamber.

13. The article of footwear according to claim 12, further comprising: a first ground-engaging component engaged with the first ground-facing lug.

14. The article of footwear according to claim 2, wherein the foot support component includes a ground-facing surface located opposite the first surface, wherein the ground-facing surface includes a continuous ground-facing element that at least partially encloses the first interior chamber and the second interior chamber.

15. An article of footwear, comprising:

an upper component having a plurality of through hole openings;

a foot support component having a first surface, wherein the foot support component is shaped to form a plurality of receptacles, each receptacle having an interior chamber, and wherein a plurality of openings corresponding to the plurality of receptacles are defined at the first surface, the openings of the plurality of openings providing access to a corresponding interior chamber; and an inflatable bladder including: (i) a first sheet for supporting at least a portion of a plantar surface of a wearer's foot, (ii) a second sheet opposite the first sheet, and (iii) a plurality of inflatable lugs extending from the second sheet, wherein a sealed fluid chamber is defined between the first sheet and the second sheet, wherein the sealed fluid chamber extends within the plurality of inflatable lugs, wherein the plurality of inflatable lugs extend through corresponding through hole openings of the upper component and into corresponding receptacles of the foot support component, and wherein, when inflated with a gas, the plurality of inflatable lugs have a size and/or shape and/or rigidity that inhibit the inflatable lugs from pulling out of the corresponding interior chamber through the corresponding opening of the plurality of openings.

16. The article of footwear according to claim 15, wherein the foot support component includes a ground-facing surface located opposite the first surface, wherein the ground-facing surface includes one or more ground-facing elements that at least partially enclose one or more interior chambers formed in one or more of the plurality of receptacles.

17. The article of footwear according to claim 16, further comprising: one or more ground-engaging components engaged with at least one of the one or more ground-facing elements.

18. The article of footwear according to claim 15, wherein the upper component, the foot support component, and the inflatable bladder are engaged together in an adhesive-free manner.

19. The article of footwear according to claim 15, wherein the plurality of through hole openings and the plurality of inflatable lugs are arranged in a plurality of rows extending in a medial side-to-lateral side direction of the article of footwear and/or in a plurality of columns extending in an anterior-to-posterior direction of the article of footwear.

20. The article of footwear according to claim 15, wherein the upper component includes a first surface and a second surface located opposite the first surface, wherein the first surface of the upper component lies immediately adjacent the first surface of the foot support component, and wherein the second surface of the upper component lies immediately adjacent the second sheet of the inflatable bladder.

* * * * *